US010602828B2

(12) United States Patent
Byun

(10) Patent No.: US 10,602,828 B2
(45) **Date of Patent: *Mar. 31, 2020**

(54) CASE FOR LIQUID STATE COSMETICS

(71) Applicant: Young-Kwang Byun, Seoul (KR)

(72) Inventor: Young-Kwang Byun, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/958,539

(22) Filed: Apr. 20, 2018

(65) Prior Publication Data

US 2019/0059549 A1 Feb. 28, 2019

(30) Foreign Application Priority Data

Aug. 23, 2017 (KR) ..... 10-2017-0106897

(51) Int. Cl.
*A45D 34/00* (2006.01)
*B05B 11/00* (2006.01)

(52) U.S. Cl.
CPC ..... *A45D 34/00* (2013.01); *B05B 11/3052* (2013.01); *A45D 2200/056* (2013.01)

(58) Field of Classification Search
CPC ..... A45D 34/00; A45D 2200/055
USPC ..... 222/321.1, 207
See application file for complete search history.

(56) References Cited

U.S. PATENT DOCUMENTS 5,152,434 A * 10/1992 Birmelin ..... B05B 11/3001 222/207
5,306,125 A * 4/1994 Weag ..... B05B 11/0027 222/207
5,518,147 A * 5/1996 Peterson ..... B05B 11/3035 222/153.07
5,664,703 A * 9/1997 Reifenberger ..... B05B 11/0064 222/207
5,819,990 A * 10/1998 Cimentepe ..... B05B 11/0067 222/207
8,881,946 B2 * 11/2014 Lee ..... A45D 33/02 132/299

(Continued)

FOREIGN PATENT DOCUMENTS

KR 2008-0092814 A 10/2008
KR 20080092814 A 10/2008

(Continued)

OTHER PUBLICATIONS

Office Action dated Nov. 12, 2018 issued in corresponding Korean Patent Application No. 10-2017-0138650.

(Continued)

*Primary Examiner* — Patrick M. Buechner
*Assistant Examiner* — Michael J. Melaragno
(74) *Attorney, Agent, or Firm* — Kaplan Breyer Schwarz, LLP

(57) ABSTRACT

Provided is a case for liquid state cosmetics. The case for liquid state cosmetics includes a case body in which a liquid content is contained, a shoulder unit coupled to an upper portion of the case body and having a content discharge hole at a central portion thereof, a pumping unit inserted into the shoulder part and connected to the content discharge hole to discharge the content through pumping action due to elasticity, and a button unit coupled to an upper portion of the shoulder unit and connected to the pumping unit to operate the pumping unit so that the content is discharged by pumping action of the pumping unit.

11 Claims, 32 Drawing Sheets

(56) References Cited

U.S. PATENT DOCUMENTS 10,010,153 B2 * 7/2018 Kim ..... A45D 34/00
10,104,951 B2 * 10/2018 Lee ..... A45D 33/025
2001/0017305 A1 * 8/2001 Bonningue ..... B05B 11/3028 222/207
2007/0131719 A1 * 6/2007 Masuda ..... B05B 11/0029 222/256
2008/0061083 A1 * 3/2008 Masuda ..... B05B 11/0029 222/256
2009/0283548 A1 * 11/2009 Hummel ..... B05B 11/3001 222/321.7
2010/0116849 A1 * 5/2010 Lautre ..... B05B 11/0029 222/153.13
2012/0024904 A1 * 2/2012 Doulin ..... B05B 11/3035 222/207
2012/0305606 A1 * 12/2012 Lee ..... A45D 33/02 222/256
2014/0103071 A1 * 4/2014 Park ..... A45D 34/00 222/207
2014/0346195 A1 * 11/2014 Doulin ..... B05B 11/0067 222/207
2016/0015149 A1 * 1/2016 Kim ..... A45D 34/00 222/383.1
2016/0073761 A1 * 3/2016 Lee ..... A45D 33/025 132/298
2016/0136666 A1 * 5/2016 Kang ..... B05B 11/3028 222/182
2016/0227903 A1 * 8/2016 Kang ..... A45D 34/00
2016/0242529 A1 * 8/2016 Oh ..... A45D 34/00
2017/0049213 A1 * 2/2017 Kang ..... A45D 34/00
2017/0056905 A1 * 3/2017 Lee ..... B05B 11/3001
2017/0273437 A1 * 9/2017 Kim ..... A45D 34/00
2017/0280852 A1 * 10/2017 Kang ..... A45D 34/00
2017/0305642 A1 * 10/2017 Kang ..... A45D 40/26
2017/0318938 A1 * 11/2017 Lee ..... A45D 40/0075
2017/0347772 A1 * 12/2017 Kang ..... A45D 34/00
2018/0085767 A1 * 3/2018 Kang ..... B05B 11/0044
2018/0116371 A1 * 5/2018 Kim ..... A45D 34/00
2018/0140073 A1 * 5/2018 Chang ..... A45D 40/0075
2018/0186551 A1 * 7/2018 Lee ..... A45D 34/042
2018/0271251 A1 * 9/2018 Yeo ..... A45D 34/00
2018/0271255 A1 * 9/2018 Hong ..... A45D 34/00
2018/0279741 A1 * 10/2018 Oh ..... A45D 34/00

FOREIGN PATENT DOCUMENTS

KR 100898619 B1 5/2009
KR 20-2011-0008182 U 8/2011
KR 20-2012-0003278 5/2012
KR 20120003279 U 5/2012
KR 20-0461424 7/2012
KR 2012-0138869 A 12/2012
KR 20120138869 A 12/2012
KR 101367880 B1 2/2014
KR 101378369 B1 3/2014
KR 2017-0062802 A 6/2017
KR 20170062802 A 6/2017
WO 2017/022996 A1 2/2017

OTHER PUBLICATIONS

Non-Final Rejection received for U.S. Appl. No. 15/958,509, dated Jan. 10, 2019, 12 pages.
Extended European Search Report issued in EP Application No. 18176240.0 dated Feb. 5, 2019.
Examiner initiated interview summary received for U.S. Appl. No. 15/958,509, dated Sep. 5, 2019, 2 pages.
Final Rejection received for U.S. Appl. No. 15/958,509, dated Jun. 7, 2019, 13 pages.
Notice of Allowance received for U.S. Appl. No. 15/958,509, dated Sep. 5, 2019, 7 pages.

* cited by examiner

CASE FOR LIQUID STATE COSMETICS

CROSS-REFERENCE TO RELATED APPLICATION

This application claims priority to and the benefit of Korean Patent Application No. 10-2017-0106897 filed in the Korean Intellectual Property Office on Aug. 23, 2017, the entire contents of which are incorporated herein by reference.

BACKGROUND OF THE INVENTION

(a) Field of the Invention

The present invention relates to a case for liquid state cosmetics, and more particularly, to a case for liquid state cosmetics, which is capable of being used by adequately discharging liquid content stored in the case.

(b) Description of the Related Art

In general, liquid state cosmetics for make-up are contained in a case and are used by discharging the liquid content in the case during the make-up. The case for the liquid state cosmetics according to the related art includes a case body in which a content is contained, a pumping member coupled to an upper portion of the case body to perform pumping action, and a button member disposed above the pumping member to allow a user to perform the pumping action through pressing.

In the above-described case for the cosmetics according to the related art, when the user presses the button member, the pumping member disposed below the button member operates to discharge the content contained in the case body to the outside. Thus, the pumping member is complicated in structure, and thus, an assembly process is cumbersome. In addition, the number of parts increases to increase manufacturing costs, and malfunction occurs.

Also, the pumping member is provided as a spring made of a metal material, and thus, the content may be deteriorated due to corrosion of the spring.

To solve these problems, "Pumping-Type Cosmetic Case" has been disclosed in Korean Patent Registration No. 10-1378369.

In the pumping-type cosmetic case disclosed in the registration patent, a pumping member that discharges a content through pumping action is made of an elastic material. The pumping member includes a coupling part coupled to a fixing groove of a valve member, a bellows tube extending from the coupling part so as to be contracted and released, a button support part disposed on an end of the bellows tube, and an elastic discharge part extending to the inside of the button support part and spared by a pressure of the content to discharge the content.

Also, a sealing shaft is fitted into and coupled to the elastic discharge part to open and close the elastic discharge part of the pumping member.

In the registration patent, the pumping action may be implemented by using a bellows tube made of a rubber material instead of the conventional spring made of the metal material. Thus, the spring made of the metal material may not be used to prevent the content from being deteriorated due to the corrosion of the spring.

However, in the registration patent, a check valve-shaped structure in which the sealing shaft having a rod shape is simply fitted into and coupled to the elastic discharge part from an upper side of the pumping member may be provided. Thus, when a decompression vacuum test is performed, the elastic discharge part is spread at a relatively low pressure, e.g., a pressure of about 200 bars to allow the content to leak between the elastic discharge part and the sealing shaft.

Also, according to the related art, when the button member is pushed, since the elastic discharge hole is suddenly spread in a state in which an internal pressure is applied to the pumping member, i.e., the internal pressure of the pumping member is not removed, the content may be not be smoothly discharged by a fixed quantity, but be sharply discharged.

PRIOR ART DOCUMENT

Patent Document (Patent Document 1) Korean Patent Registration No. 10-1378369 (Mar. 27, 2014)

SUMMARY OF THE INVENTION

A technical object to be achieved by the present invention is to provide a case for liquid state cosmetics, in which the number of components is reduced to be simplified in structure and to reduce manufacturing costs.

A technical object to be achieved by the present invention is to provide a case for liquid state cosmetics, in which leakage of a content is prevented during a decompression vacuum test.

A technical object to be achieved by the present invention is to provide a case for liquid state cosmetics, in which a content accommodated in the case is smoothly discharged by a fixed quantity when a button is pushed To achieve the technical object, a case for liquid state cosmetics according to a preferred embodiment of the present invention includes: a case body in which a liquid content is contained; a shoulder unit coupled to an upper portion of the case body and having a content discharge hole at a central portion thereof; a pumping unit inserted into the shoulder part and connected to the content discharge hole to discharge the content through pumping action due to elasticity; and a button unit coupled to an upper portion of the shoulder unit and connected to the pumping unit to operate the pumping unit so that the content is discharged by pumping action of the pumping unit.

The pumping unit may include: a pumping member which is made of an elastic material so that the content is discharged through the pumping action such as compression and expansion due to the elasticity and through which a content moving passage connected to the content discharge hole passes through the inside thereof;

a valve member provided in a lower portion of the pumping member to open a lower side of the content moving passage communicating with the content discharge hole; a nozzle member inserted into an upper portion of the pumping member to open and close an upper side of the content moving passage while coming into contact and non-contact with the pumping member when the pumping member is elastically deformed, thereby discharging the content; and a pumping cap which is coupled to an upper portion of the pumping member and in which a discharge tube connected to the nozzle member is disposed on an upper portion thereof.

The pumping member may include: a valve mounting part inserted into and coupled to a content discharge hole of the shoulder unit and provided with the valve member therein; a bellows part extending upward from the valve mounting part in a bellows shape and compressed and expanded to perform pumping action due to elasticity; and a nozzle insertion part which extends upward from the bellows part and is coupled to a lower portion of the pumping cap and in which the nozzle member is inserted therein.

The pumping member may further include an undercut part stepped so that a lower inner diameter thereof is more expanded than an upper inner diameter thereof on an inner circumferential surface of the nozzle insertion part.

In the state in which the nozzle member is inserted into the nozzle insertion part, a flange part protruding outward from a lower end of the nozzle member may be closely attached to and supported by the undercut part, and when the button unit is pushed downward, the bellows part may be vertically compressed and elastically deformed in an external radius direction to release the close attachment with the flange part and open the undercut part so that the content is discharged, and when the button unit returns upward, the bellows part is vertically expanded and elastically deformed in an internal radius direction so as to be closely attached to the flange part and seal the undercut part and thereby to block the discharge of the content.

The pumping member may further include: an elastic part having a corrugated shape bent at least once at an intermediate portion in a longitudinal direction of the nozzle insertion part and compressed and expanded in the longitudinal direction of the nozzle insertion part when the pushing and pushing-releasing operation are performed to apply elastic force to the button unit.

In the state in which the nozzle member is inserted into the nozzle insertion part, the flange part protruding outward from a lower end of the nozzle member may be closely attached to the undercut part, and when the button unit is pushed downward, the elastic part is compressed downward by the pumping cap to allow the nozzle member to descend so that the close attachment of the undercut part to the flange part is released to open the undercut part and thereby to discharge the content, and when the button unit returns upward, the elastic part may be expanded upward to allow the nozzle member to ascend so that the undercut part is closely attached to the flange part to block the discharge of the content.

The undercut part may be provided as a stepped groove having an inner diameter corresponding to an outer diameter of the flange part on an inner circumferential surface of a connection portion between an upper end of the bellows part and a lower end of the nozzle insertion part.

The bellows part may be configured to connect the valve mounting part to the nozzle insertion part below the undercut part and have a corrugated tube shape, and when the button unit is pushed downward, the bellows part may be elastically deformed to apply a pumping pressure to the content within the pumping member.

The nozzle member may include: a nozzle body inserted into a nozzle fixing tube protruding from a lower portion of the pumping cap and connected to the discharge tube and having a nozzle hole therein and an inflow hole connected to the nozzle hole to introduce the content into the nozzle hole in a side portion thereof;

an inflow guide piece radially protruding from an outer circumferential surface of the nozzle body to provide a content inflow path between the nozzle fixing tube and the nozzle body and thereby to guide the content into the inflow hole; and a flange part protruding in an annular shape from a lower end of the nozzle body, having an outer diameter corresponding to an inner diameter of the undercut part, and inserted into the nozzle insertion part so as to be closely attached to and supported by the undercut part.

The pumping cap may further include: a cap body inserted into a shoulder tube protruding from an upper portion of the shoulder unit; a discharge tube protruding from a center of an upper portion of the cap body and connected to a content outlet tube disposed in the button unit; and a nozzle fixing tube protruding from a center of a lower portion of the cap body to communicate with the discharge tube, inserted into and coupled to the upper end of the pumping member, having a nozzle fixing groove, into which the upper end of the nozzle body is fitted into and fixed to in the state in which the nozzle body is inserted, in an upper portion thereof.

The pumping cap may further include: a decompression support extending to protrude downward from a lower portion of the cap body at a predetermined distance with respect to an outer circumferential surface of the nozzle fixing tube and supporting an outer circumferential surface of the nozzle insertion part inserted into and coupled to the outside of the nozzle fixing tube, wherein the decompression support may support the outside of the nozzle insertion part on which the undercut part is disposed when a decompression vacuum test is performed on the case for the liquid state cosmetics to prevent the undercut part from being opened by a pressure within the bellows part and thereby to prevent the content from leaking through the undercut part.

The decompression support may extend up to a connection portion between an upper end of the bellows part and a lower end of the nozzle insertion part.

The valve member may be integrated with the pumping member.

The valve member may include a check valve which extends to the inside of the valve mounting part to form an upward cone shape and in which a slit hole is defined in an upper end thereof so that the slit hole is spread or closed by a pressure to open and close the content moving passage, wherein, when the button unit is pushed downward, the slit hole may be closed by the pressure within the pumping member to seal the check valve, and after the check valve is sealed first, the bellows part may be vertically compressed and elastically deformed in an outer radius direction to release the close attachment with the flange part and open the undercut part and thereby to discharge the content within the pumping member through the undercut part, and when the button unit returns upward, the bellows part may be vertically expanded and elastically deformed in an internal radius direction so as to be closely attached to the flange part and seal the undercut part and thereby to block the discharge of the content, and after the undercut part is closed first, the slit hole is opened by the pressure within the case body to open the check valve and thereby to fill the content into the pumping member.

The valve member may include a disk valve in which a disk plate is disposed inside the valve mounting part, a plurality of valve holes are defined between elastic connection pieces connecting the disk plate to the valve mounting part, and the disk plate ascends and descends by elastic deformation of the elastic connection pieces to open and close the content moving passage within the valve mounting part, wherein, when the button unit is pushed downward, the disk plate may descend by the pressure within the pumping member to seal the disk valve, and after the disk valve is sealed first, the bellows part is vertically compressed and elastically deformed in an outer radius direction to release the close attachment with the flange part and open the undercut part and thereby to discharge the content within the pumping member through the undercut part, and when the button unit returns upward, the bellows part may be vertically expanded and elastically deformed in an internal radius direction so as to be closely attached to the flange part and seal the undercut part and thereby to block the discharge of the content, and after the undercut part is closed first, the disk plate may ascend by the pressure within the case body to open the disk valve and thereby to fill the content into the pumping member.

DETAILED DESCRIPTION OF THE INVENTION

A case for liquid state cosmetics according to preferred embodiments of the present invention will be described below in detail with reference to the accompanying drawings.

For reference, detailed descriptions related to well-known functions or configurations will be ruled out in order not to unnecessarily obscure subject matters of the present invention.

Figure 1:
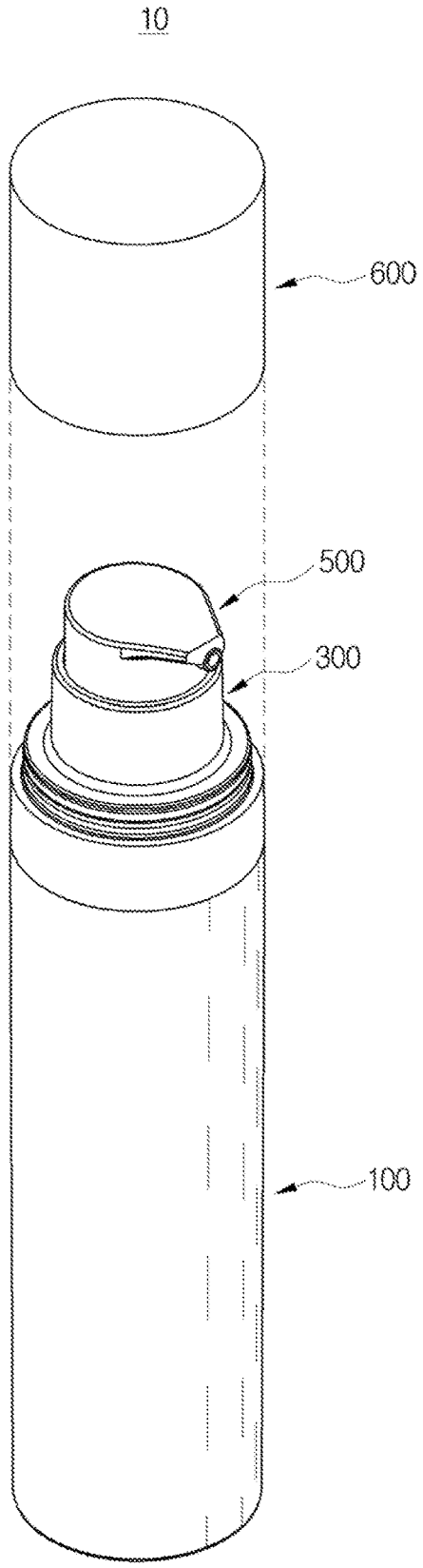
FIG. 1 is a perspective view of a case for liquid state cosmetics according to an embodiment of the present invention.
Figure 2:
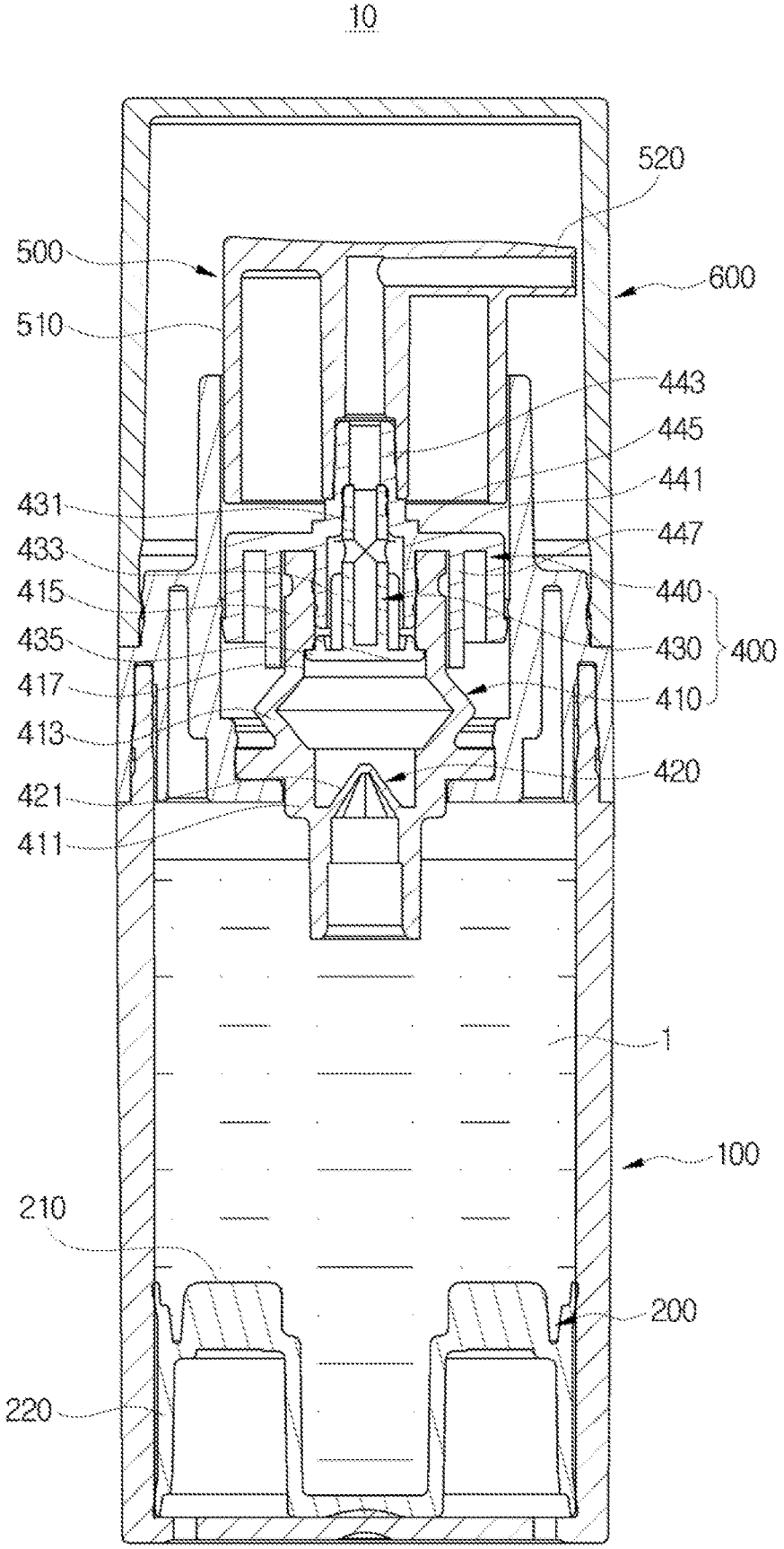
FIG. 2 is a longitudinal cross-sectional view of the case for the liquid state cosmetics according to an embodiment of the present invention.
Figure 3:
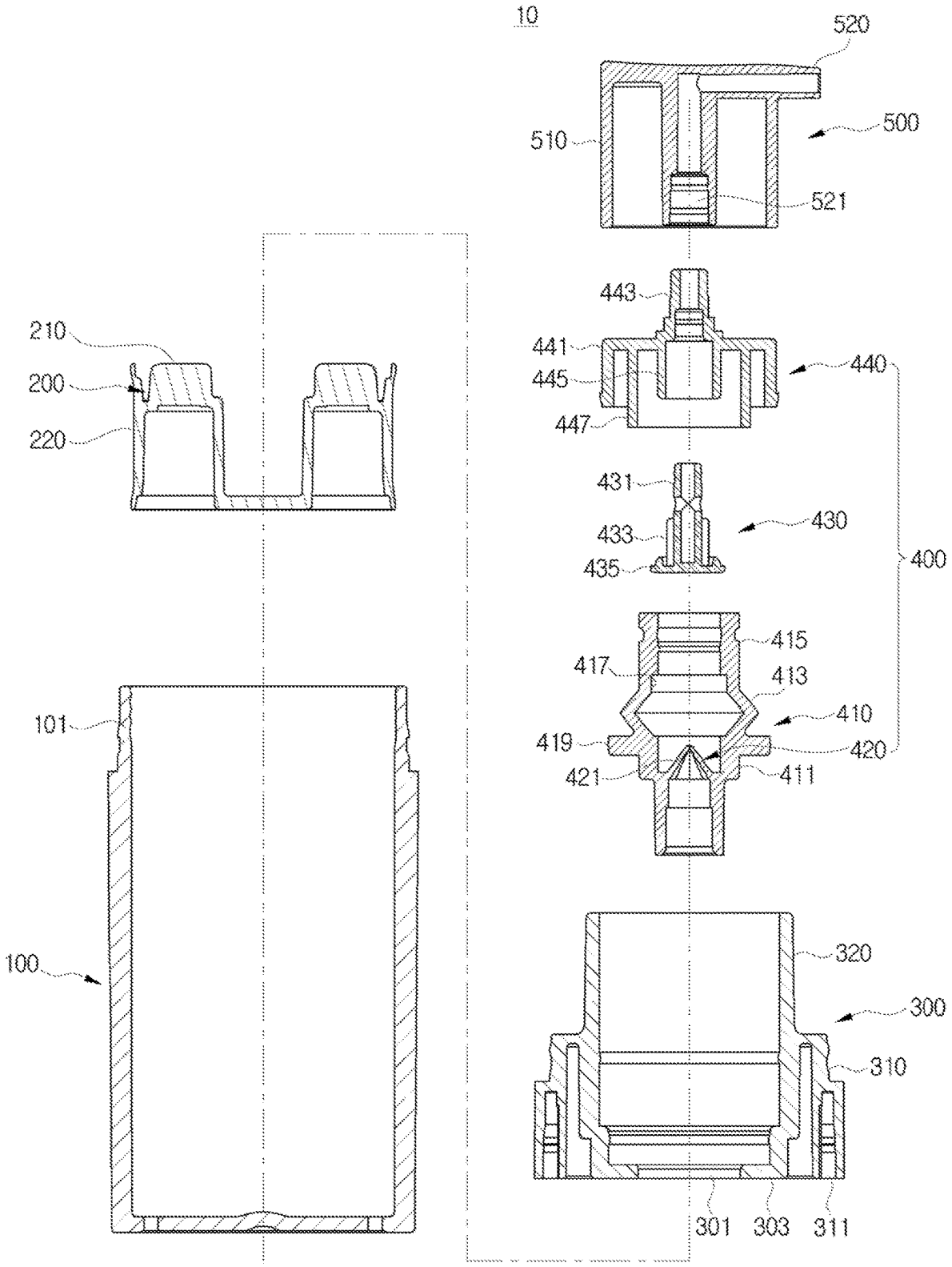
FIG. 3 is an exploded view of FIG. 2.

FIG. 1 is a perspective view of a case for liquid state cosmetics according to an embodiment of the present invention, FIG. 2 is a longitudinal cross-sectional view of the case for the liquid state cosmetics according to an embodiment of the present invention, and FIG. 3 is an exploded view of FIG. 2.

As illustrated in FIGS. 1 to 3, a case 10 for liquid state cosmetics according to an embodiment of the present invention may include a case body 100, a pressing holder unit 200, a shoulder unit 300, a pumping unit 400, a button unit 500, and a case cap 600.

The case body 100 has a hollow cylindrical tube shape having an opened upper side and a closed lower side. A liquid cosmetics content 1 is filled into the case body 100.

Also, a shoulder coupling part 101 extending from an upper end of the case body 100 and having an outer diameter less than that of the case body 100 so that an inner circumferential surface of the shoulder part 300 is fitted into and coupled to an outer circumferential surface of the shoulder coupling part 101 may be provided on the case body 100.

The pressing holder unit 200 is slidably inserted into the case body 100 to press and push the content 1 toward a discharge side of the case body 100 so that the content 1 within the case body 100 is smoothly discharged.

The content 1 is filled between the pressing holder unit 200 and the shoulder unit 300 in the case body 100.

The pressing holder unit 200 may include a pressing part 210 inserted into the case body 100 to push the content 1 toward the discharge side of the case body 100 and a contact part 220 disposed on an edge of the pressing part 210 to slidably contact the inner circumferential surface of the case body 100.

The contact part 220 may have a shape of which a central portion is more recessed toward a center of the pressing part 210 than both ends thereof.

Thus, the central portion of the contact part 220 may do not come into contact with an inner circumferential surface of the case body 100, but only both the ends of the contact part 220 may come into slidable contact with the inner circumferential surface of the case body 100.

The shoulder unit 300 is fitted into and coupled to the outside of an upper end of the case body 100.

The shoulder unit 300 may include the shoulder body 310 and the shoulder tube 320.

The shoulder body 310 may have a circular shape to cover an upper opening portion of the case body 100, and a coupling groove may be defined in a lower inner circumferential surface of the shoulder body 310, and thus, the shoulder coupling part 101 disposed on an upper end of the case body 100 is fitted into and coupled to the coupling groove 311.

Also, an inner circumferential surface of a lower end of a case lid part 600 is fitted into and coupled to an outer circumferential surface of an upper end of the shoulder body 310.

The shoulder tube 320 has a hollow circular tube shape protruding upward from the shoulder body 310, and a content discharge hole 301 communicating with the inside of the case body 100 is defined in a lower center of the shoulder tube 320.

Also, a hook protrusion 303 outside the content discharge hole 301 is disposed on a lower end of the shoulder tube 320. Thus, a hook projection 419 of a pumping member 410 that will be described later may be supported by the hook protrusion 303.

Also, in a state in which a pumping unit 400 that will be described later is inserted into the shoulder tube 320, the button unit 500 is elevatably coupled to the inside of the upper end of the shoulder tube 320.

The pumping unit 400 is inserted into the shoulder tube 320 of the shoulder unit 300 and connected to the content discharge hole 301 to discharge the content 1 through pumping action due to elasticity.

The pumping unit 400 may include a pumping member 410, a valve member 420, a nozzle member 430, and a pumping cap 440.

The pumping unit 400 will be described below in detail with reference to FIGS. 4 to 16.

The button unit 500 is coupled to the upper portion of the shoulder unit 300 and connected to the pumping unit 400 to operate the pumping unit 400 so that the content 1 is discharged by the pumping action of the pumping unit 400.

The button unit 500 may include a button body 510 and an outlet tube 520.

The button body 510 has a circular tube shape and is elevatably coupled to the upper end of the shoulder tube 320, and the pumping action of the pumping unit 400 may be realized through vertical pushing and pushing-releasing operations of the button body 510.

The outlet tube 520 is provided from a central portion to a side surface of the button body 510 so that an outlet of the outlet tube 520 is directed to a side surface of the button body 510.

A discharge tube coupling groove 521 into which the upper end of a discharge tube 443 of a pumping cap that will be described later is fitted and coupled is defined in a lower end of a central portion of the outlet tube 520.

The case lid unit 600 has a sealed upper portion and an opened lower portion having a circular tube shape. The inside of a lower end of the case lid unit 600 is detachably coupled to the outside of the shoulder body 310 of the shoulder unit 300, and thus, in use, the case lid unit 600 is separated from the shoulder unit 300 to expose the button unit 500 to the outside. On the other hand, when is not used, the case lid unit 600 is coupled to the shoulder unit 300 to cover the button unit 500 so that the button unit 500 is not exposed to the outside.

Figure 4:
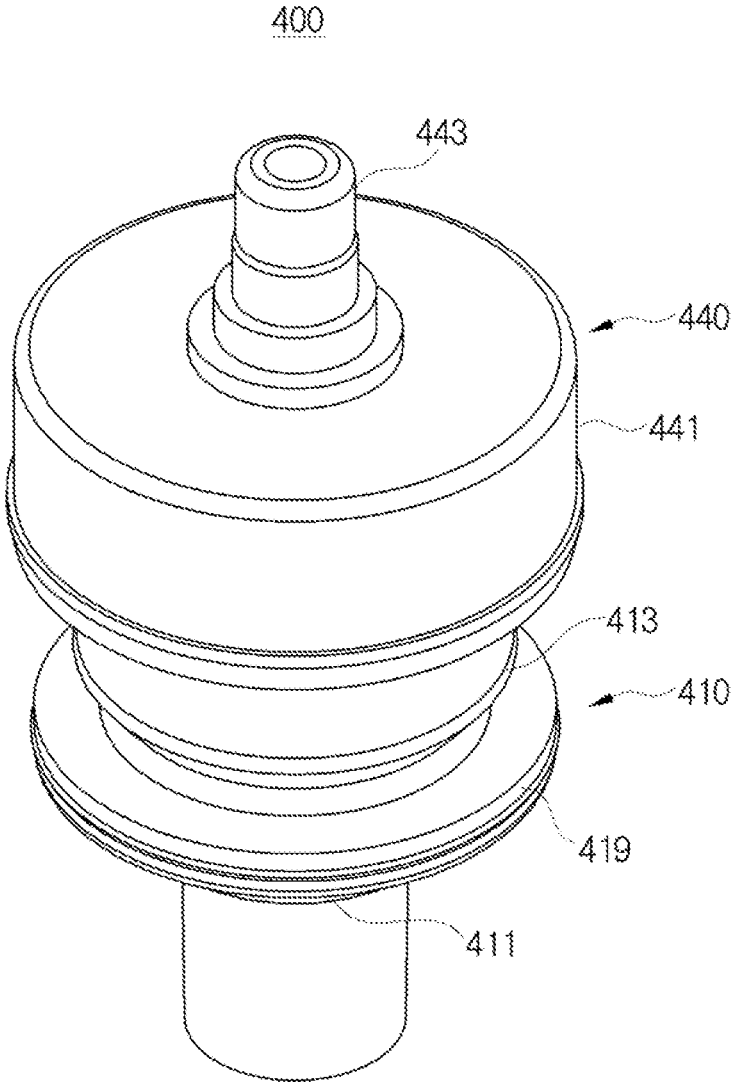
FIG. 4 is a perspective view illustrating a pumping unit of a case for the liquid state cosmetics according to an embodiment of the present invention.
Figure 5:
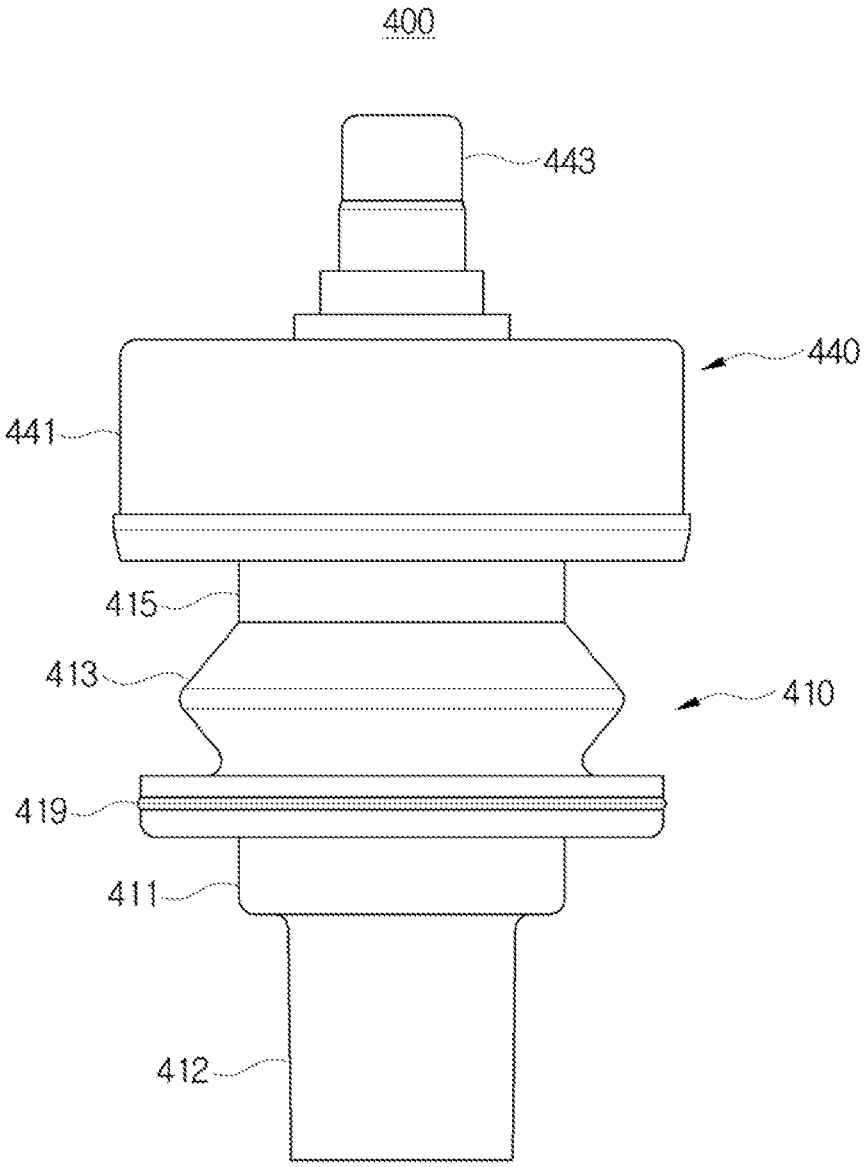
FIG. 5 is a front view of FIG. 4.
Figure 6:
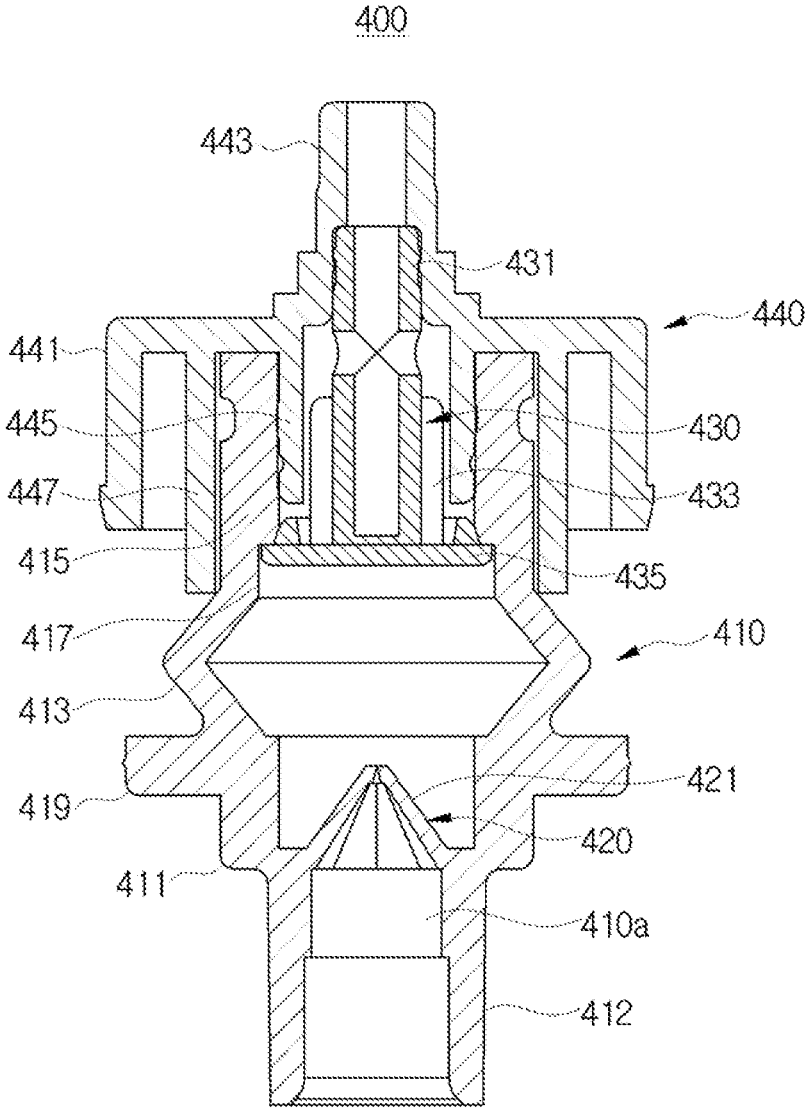
FIG. 6 is a longitudinal cross-sectional view of FIG. 4.

FIG. 4 is a perspective view illustrating the pumping unit of the case for the liquid state cosmetics according to an embodiment of the present invention, FIG. 5 is a front view of FIG. 4, and FIG. 6 is a longitudinal cross-sectional view of FIG. 4.

As illustrated in FIGS. 4 to 6, the pumping unit 400 of the case 10 of the liquid state cosmetics according to an embodiment of the present invention may include the pumping member 410, the valve member 420, the nozzle member 430, and the pumping cap 440.

The pumping member 410 is made of an elastic material so that the content 1 is discharged through the pumping action such as compression and expansion due to the elasticity, and a content moving passage (see reference numeral 410*a* of FIG. 10) connected to the content discharge hole 301 of the shoulder unit 300 passes through the inside of the pumping member 410.

The pumping member 410 may include a valve mounting part 411, a bellows part 413, a nozzle insertion part 415, and an undercut part 417.

The pumping member 410 may be made of an elastic material, e.g., a synthetic resin material having elasticity, and thus, the existing spring component may be omitted.

Thus, the number of components of the pumping unit 400 may be reduced to reduce manufacturing costs.

In addition, since the pumping action is performed using the elastic synthetic resin instead of the existing spring made of the metal material, the spring made of the metal material may not be used to prevent the content from being deteriorated due to corrosion of the spring.

The valve member 420 is disposed below the pumping member 410 to open and close the content moving passage 410*a* communicating with the content discharge hole 301.

In addition, the valve member 420 is made of the same elastic material as the pumping member and is integrated with the pumping member 410.

In this embodiment, the valve member 420 is provided as a check valve 421.

The pumping member 410 and the valve member 420 will be described in detail with reference to FIGS. 7 to 10.

The nozzle member 430 is inserted into an upper portion of the pumping member 410, and an upper end of the nozzle member 430 is fitted into and fixed to the nozzle fixing groove (see reference numeral 444 of FIG. 16) of the pumping cap 440. When the pumping member 410 is elastically deformed, the nozzle member may come into contact or non-contact with the pumping member 410 and open and close the upper side of the content moving passage 410*a*, and a nozzle hole (see reference numeral 431*a* of FIG. 13) through which the content 1 is discharged is defined in the nozzle member 430.

The nozzle member 430 may include a nozzle body 431, an inflow guide piece 432, and a flange part 435.

The nozzle member 430 will be described below in detail with reference to FIGS. 11 to 13.

The pumping cap 440 is coupled to the upper portion of the pumping member 410, and the discharge tube 443 connected to the nozzle member 430 is disposed on the upper portion of the pumping cap 440.

The pumping cap 440 may include a cap body 441, a discharge tube 443, a nozzle fixing tube 445, and a decompression support 447.

The pumping cap 440 will be described below in detail with reference to FIGS. 14 to 16.

Figure 7:
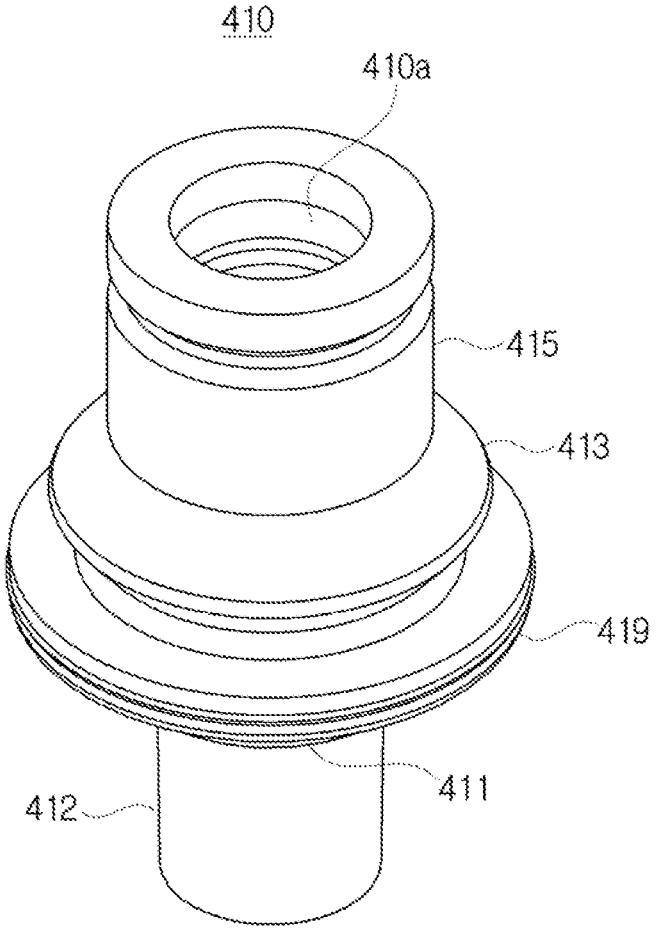
FIG. 7 is a perspective view illustrating a pumping member and a valve member of the pumping unit.
Figure 8:
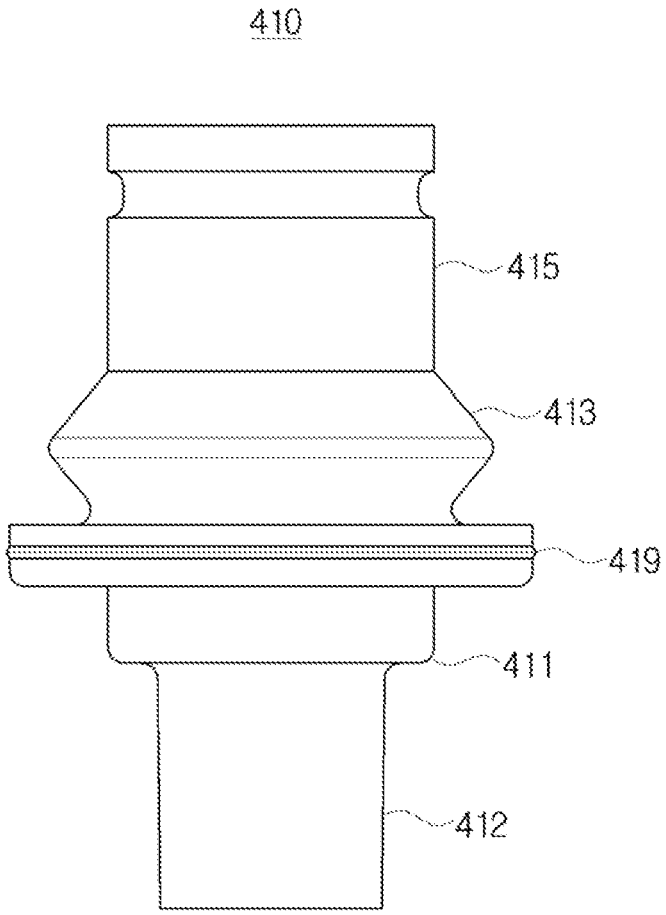
FIG. 8 is a front view of FIG. 7.
Figure 9:
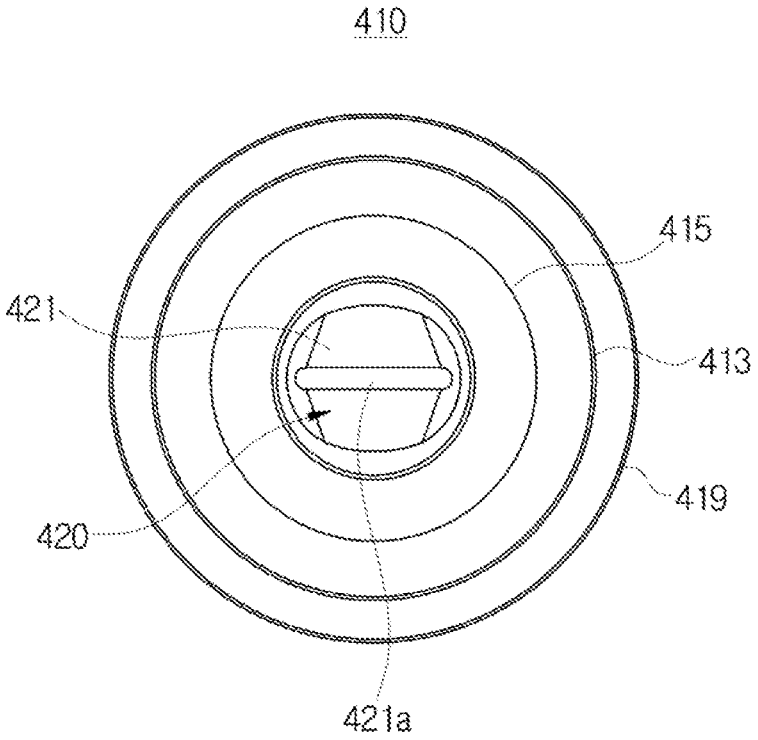
FIG. 9 is a plan view of FIG. 7.
Figure 10:
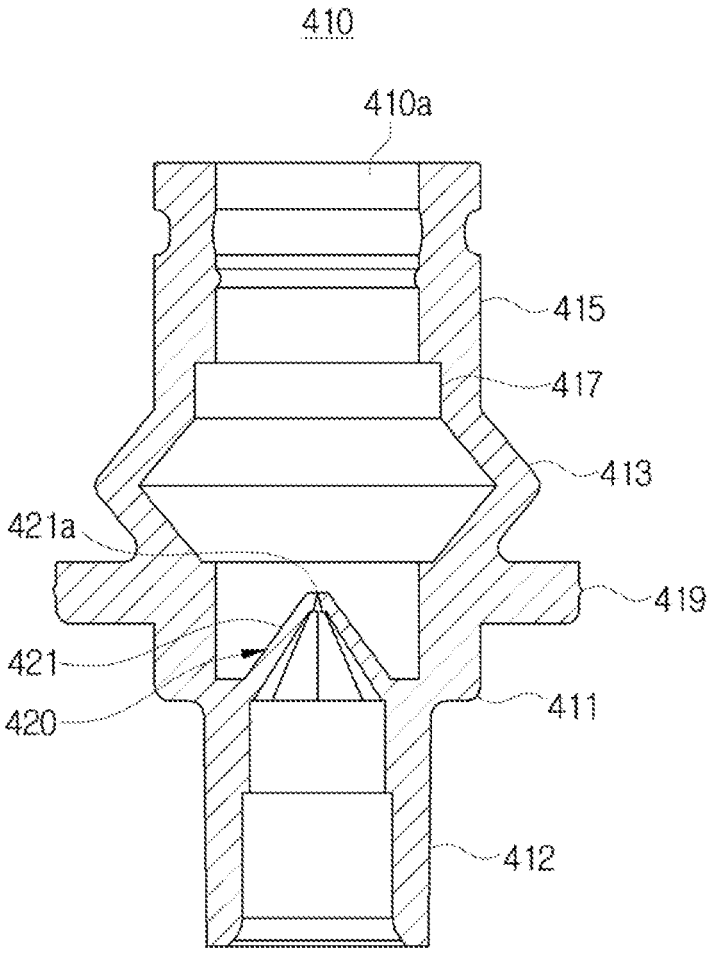
FIG. 10 is a longitudinal cross-sectional view of FIG. 7.

FIG. 7 is a perspective view illustrating the pumping member and the valve member of a pumping unit, FIG. 8 is a front view of FIG. 7, FIG. 9 is a plan view of FIG. 7, and FIG. 10 is a longitudinal cross-sectional view of FIG. 7.

As illustrated in FIGS. 7 to 10, the pumping member 410 is made of an elastic material so that the content 1 is discharged through the pumping action such as compression and expansion due to the elasticity, and the content moving passage 410*a* connected to the content discharge hole 301 of the shoulder unit 300 passes through the inside of the pumping member 410.

Also, the pumping member 410 may be made of an elastic material, e.g., a synthetic resin material having elasticity, and thus, the existing spring component may be omitted.

The pumping member 410 may include a valve mounting part 411, a bellows part 413, a nozzle insertion part 415, and an undercut part 417.

The valve mounting part 411 has a hollow circular tube shape and is inserted into and coupled to the content discharge hole 301 of the shoulder 300.

A connection tube 412 extending downward to pass through the content discharge hole 301 may be provided in the valve mounting part 411.

Also, the valve member 420 that will be described later is provided in the valve mounting part 411 to open and close the content moving passage 410*a* of the pumping member 410.

Also, a circular hook projection 419 is disposed on an outer circumferential surface of the valve mounting part 411 and supported by the hook protrusion 303 disposed on the lower end of the shoulder tube 320.

The bellows part 413 extends upward from the valve mounting part 411 in a bellows shape, e.g., a bellows tube shape and is compressed and expanded to perform the pumping action due to elasticity.

That is, the bellows part 413 may serve as the existing spring.

In this embodiment, although the bellows part 413 including one bellows tube is provided, the present invention is not limited thereto. For example, the bellows part 413 including a plurality of bellows tubes may be provided.

The nozzle insertion part 415 has a hollow circular tube shape extending upward from the bellows part 413.

The nozzle insertion part 415 is inserted into and coupled to the outside of the nozzle fixing tube 445 provided in the lower center of the pumping cap 440, and the nozzle member 430 is inserted into the nozzle insertion part 415.

Also, the nozzle insertion part 415 is fitted to be coupled between an outer circumferential surface of the nozzle fixing tube 445 of the pumping cap 440 and the decompression support 447.

The undercut part 417 is stepped so that a lower inner diameter thereof is more expanded than an upper inner diameter thereof on an inner circumferential surface of the nozzle insertion part 415.

In the state in which the nozzle member 430 that will be described later is inserted into the nozzle insertion part 415, the annular flange part 435 protruding outward at the lower end of the nozzle member 430 is closely attached to and supported by the undercut part 417.

The undercut part 417 is provided as an annular stepped groove having an inner diameter corresponding to an outer diameter of the annular flange part 435 on an inner circumferential surface of a connected portion between the upper end of the bellows part 418 and the lower end of the nozzle insertion part 415.

As described above, since the undercut part 417 is provided on the pumping member 410, when the button unit 500 is pushed downward, the bellows part 413 is compressed downward and thus elastically deformed in an external radius direction so that the close attachment with the flange part 435 is released to open the undercut part 417, and thus, the content 1 is discharged through the undercut part 417. When the button unit 500 returns upward, the bellows part 413 is expanded upward and thus elastically deformed in the inner radius direction and closely attached to the flange part 453 to seal the undercut part 417 and thereby to block the discharge of the content 1.

Also, when the decompression vacuum test is performed on the case 10 for the liquid state cosmetics, the flange part 435 of the nozzle member 430 is closely attached by the undercut part 417 to prevent the undercut part 410 from being opened by the internal pressure of the case 10, thereby preventing the content 1 from leaking through the undercut part 417.

For example, in the case in which the flange part 435 of the nozzle member 430 and the undercut part 417 of the pumping member 410 are not provided in the pumping unit 400, when the decompression vacuum test is performed, the content 1 may leak between the nozzle member 430 and the pumping member 410 at a pressure of about 200 bars. However, like the present invention, in the case in which the he flange part 435 of the nozzle member 430 and the undercut part 417 of the pumping member 410 are provided in the pumping unit 400, the flange part 435 may be closely attached to and supported by the undercut part 410. Thus, when the decompression vacuum teat is performed, the leakage of the content 1 may be prevented in a range of about 800 bar to about 1,000 bar to improve reliability of a product.

The valve member 420 is disposed below the pumping member 410 to open and close the content moving passage 410*a* communicating with the content discharge hole 301.

The valve member 420 is integrated with the pumping member 410.

Thus, if the valve member 420 is provided as a separate part with respect to the pumping member 410, the content 1 may leak through the coupled portion between the valve member 420 and the pumping member 410, and also, the assembly may be complicated. Therefore, it is preferable that the valve member 420 is integrated with the pumping member 410.

In this embodiment, although the valve member 420 is integrated with the pumping member 410, the present invention is not limited thereto. For example, the valve member 420 may be provided as a separate part and then be coupled to the pumping member 410.

The valve member 420 may include a check valve 421 which extends to the inside of the valve mounting part 411 to form an upward cone shape and in which a straight slit hole 421*a* is defined in an upper end thereof so that the slit hole 421*a* is spread or closed by a pressure to open and close the content moving passage 420*a*.

The check valve 421 is made of an elastic material so that the slit hole 421*a* is spread and closed by the pressure.

Figure 11:
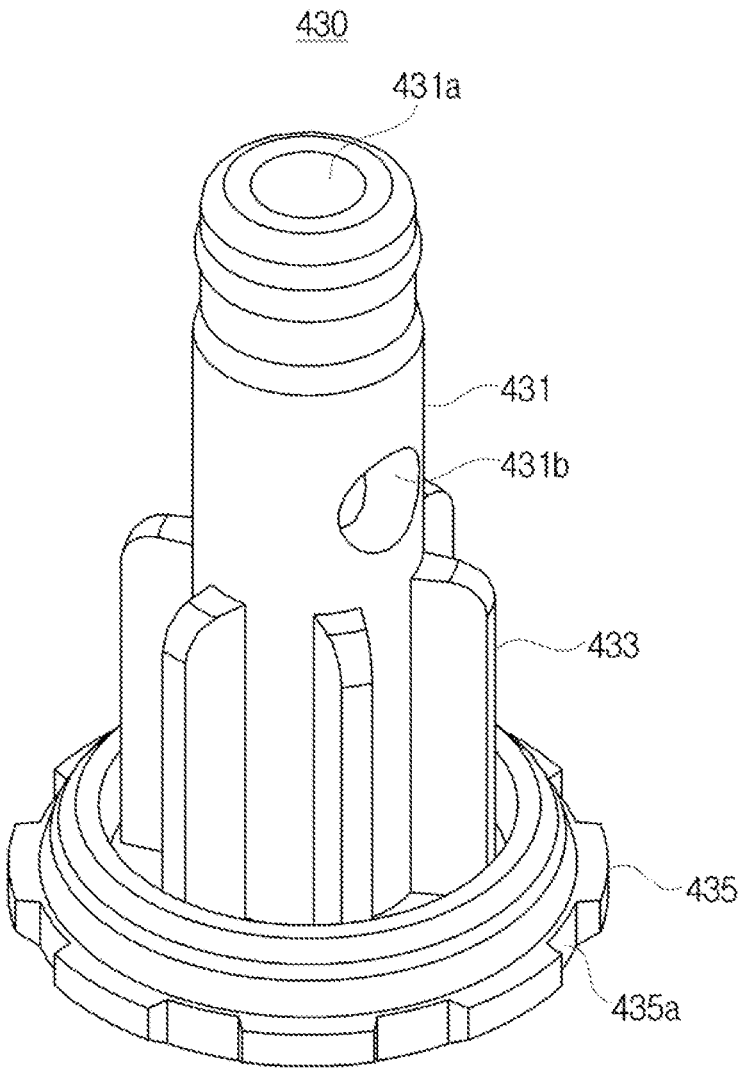
FIG. 11 is a perspective view illustrating a nozzle member of a pumping unit.
Figure 12:
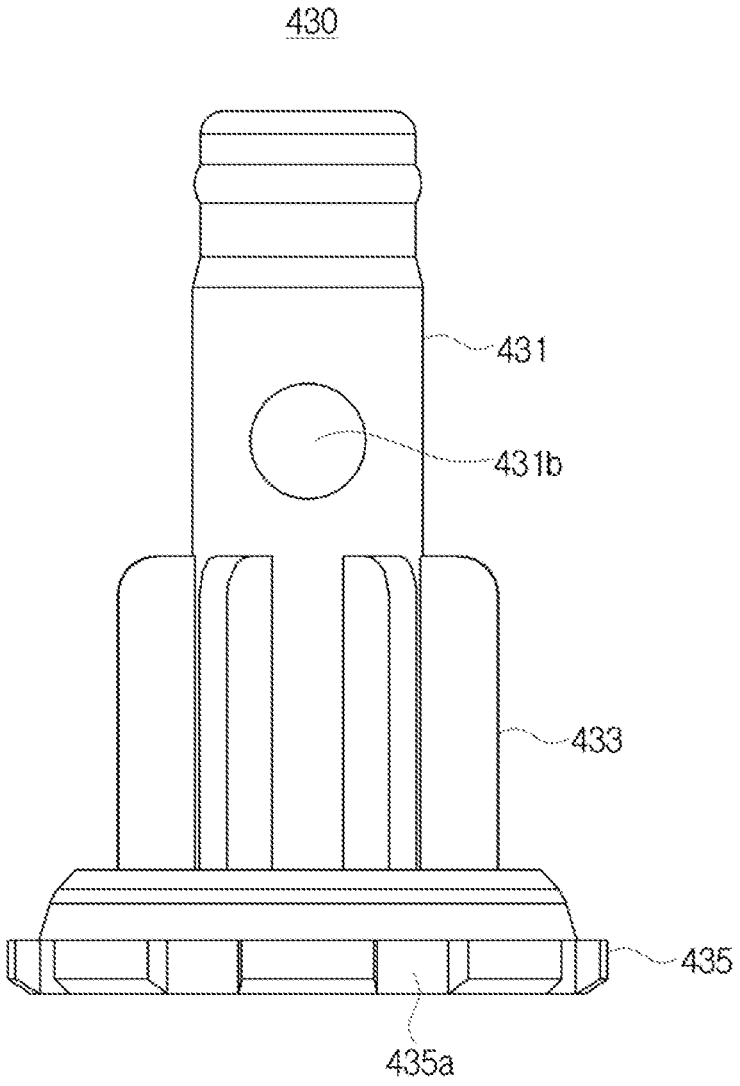
FIG. 12 is a front view of FIG. 11.
Figure 13:
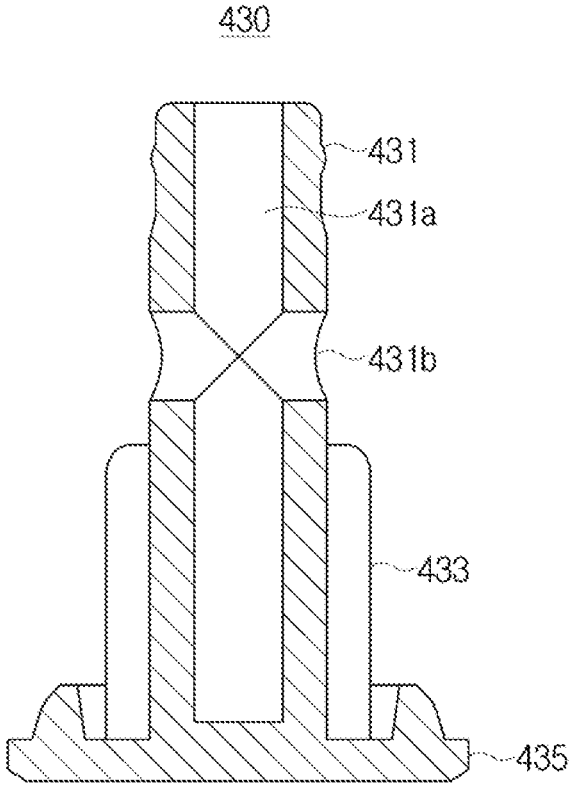
FIG. 13 is a longitudinal cross-sectional view of FIG. 11.

FIG. 11 is a perspective view illustrating the nozzle member of the pumping unit, FIG. 12 is a front view of FIG. 11, and FIG. 13 is a longitudinal cross-sectional view of FIG. 11.

As illustrated in FIGS. 11 to 13, the nozzle member 430 is inserted into the upper portion of the pumping member 410 in the state of being fixed to the nozzle fixing tube 445 of the pumping cap 440. When the pumping member 410 is elastically deformed, the nozzle member 430 comes into contact or non-contact with the pumping member 410 to open and close the upper side of the contact moving passage 410*a*.

The nozzle member 430 may include the nozzle body 431, the inflow guide piece 433, and the flange part 435.

The nozzle body 431 is inserted into the nozzle fixing tube 445 protruding from the lower portion of the pumping cap 440 and connected to the discharge tube 443, and a nozzle hole 431*a* having a closed lower end and opened upper end is lengthily defined inside the nozzle body 431. An inflow hole 431*b* connected to the nozzle hole 431*a* to allow the content 1 to be introduced into the nozzle hole 431*a* is defined in a side portion of the nozzle body 431.

Also, the upper end of the nozzle body 431 is fitted into and fixed to a nozzle fixing groove (see reference numeral 444 of FIG. 16) defined in the upper end of the nozzle fixing tube 445 in the state in which the nozzle body 431 is inserted into the nozzle fixing tube 445.

The inflow guide piece 433 is provided in plurality that radially protrude from an outer circumferential surface of the nozzle body 431. An inflow path is provided in the inflow guide piece 433 to guide the content 1 to the inflow hole 431*b* so that the content 1 passes through a gap between the nozzle fixing tube 445 and the nozzle body 431 in the state in which the nozzle body 431 is inserted into the nozzle fixing tube 445.

The flange part 435 protrudes in an annular shape from a lower end of the nozzle body, has an outer diameter corresponding to the inner diameter of the undercut part 417, and is inserted into the nozzle insertion part 415 and closely attached to and supported by the undercut part 417.

Also, a plurality of fine holes 435*a* through which the content 1 passes are defined in the flange part 435 along an outer circumferential surface of the flange part 435 at predetermined intervals.

Thus, since the flange part 435 of the nozzle member 430 is inserted into the nozzle insertion part 415 of the pumping member of the flange part 435 and thus is closely attached to the undercut part 417, when the decompression vacuum test is performed on the case 10, the undercut par 417 may be prevented from being opened by the internal pressure of the case 10, thereby preventing the content 1 from leaking through the undercut part 417.

Figure 14:
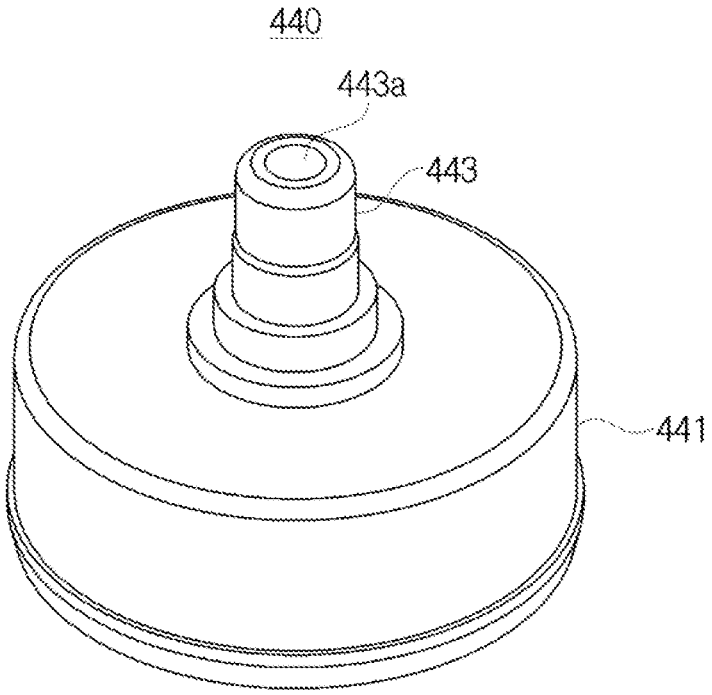
FIG. 14 is a perspective view illustrating a pumping cap of the pumping unit.
Figure 15:
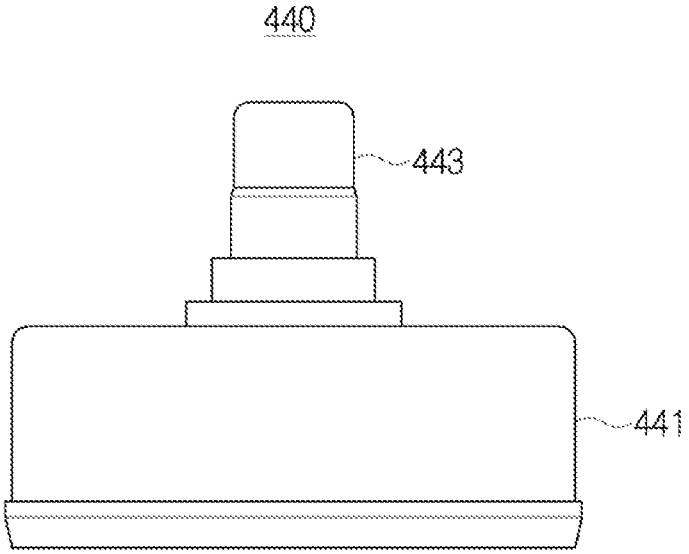
FIG. 15 is a front view of FIG. 14.
Figure 16:
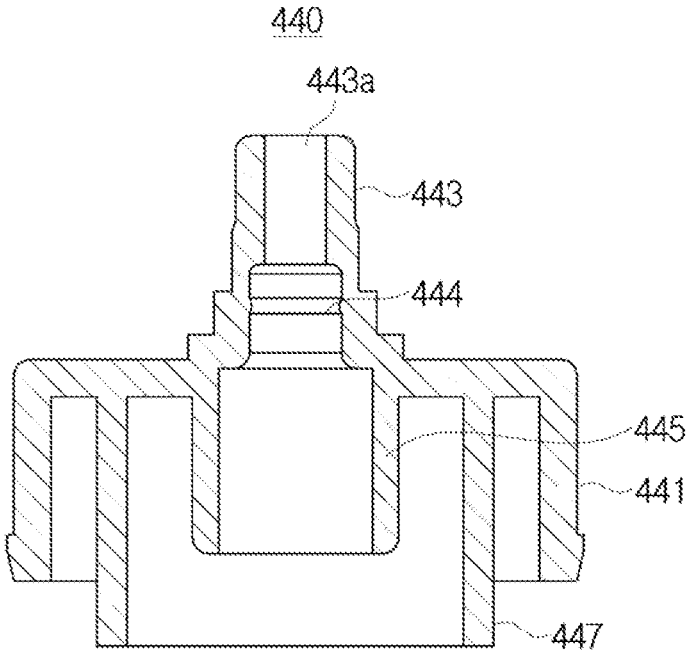
FIG. 16 is a longitudinal cross-sectional view of FIG. 14.

FIG. 14 is a perspective view illustrating the pumping cap of the pumping unit, FIG. 15 is a front view of FIG. 14, and FIG. 16 is a longitudinal cross-sectional view of FIG. 14.

As illustrated in FIGS. 14 to 16, the pumping cap 440 is coupled to the upper end of the pumping member 410, the discharge tube 443 connected to the nozzle member 430 is disposed in the upper portion of the pumping cap 440, and the upper portion of the pumping cap 440 is coupled to the button unit 500.

The pumping cap 440 may include the cap body 441, the discharge tube 443, the nozzle fixing tube 445, and the decompression support 447.

The cap body 441 has a sealed top surface. The cap body 441 has a circular tube shape of which the outside of the top surface is bent downward and is inserted into the shoulder tube 320 of the shoulder unit 300.

Here, the cap body 441 has an outer diameter corresponding to an inner diameter of the shoulder tube 320.

The discharge tube 443 protrudes from a center of the upper portion of the cap body 441, and a discharge hole 443*a* is defined in the discharge tube 443. The discharge tube 443 is fitted into a discharge tube coupling part 521 provided in a center of the lower portion of the button unit 500 and connected to the content outlet tube 520.

The nozzle fixing tube 445 has a circular tube shape that protrudes from a center of the lower portion of the cap body 441, and an upper portion of the nozzle fixing tube 445 communicates with the discharge tube 443 and is inserted into and coupled to the upper end of the pumping member 410.

Also, in the state in which the nozzle body is inserted into the nozzle fixing tube 445, a nozzle fixing groove 444 is defined in an inner upper portion of the nozzle fixing tube 445 so that the upper end of the nozzle body 431 is fitted into and fixed to the nozzle fixing tube 445.

The decompression support 447 has a circular tube shape extending to protrude from the lower portion of the cap body 441 at a predetermined distance with respect to the outer circumferential surface of the nozzle fixing tube 445, e.g., a distance corresponding to a thickness of a sidewall of the nozzle insertion part 415 to support the outer circumferential surface of the nozzle insertion part 415 coupled to the outside of the nozzle fixing tube 445.

Here, the decompression support 447 extends up to the connected portion between the upper end of the bellows part 413 and the lower end of the nozzle insertion part 415, i.e., a position on which the undercut part 417 is disposed.

Figure 17:
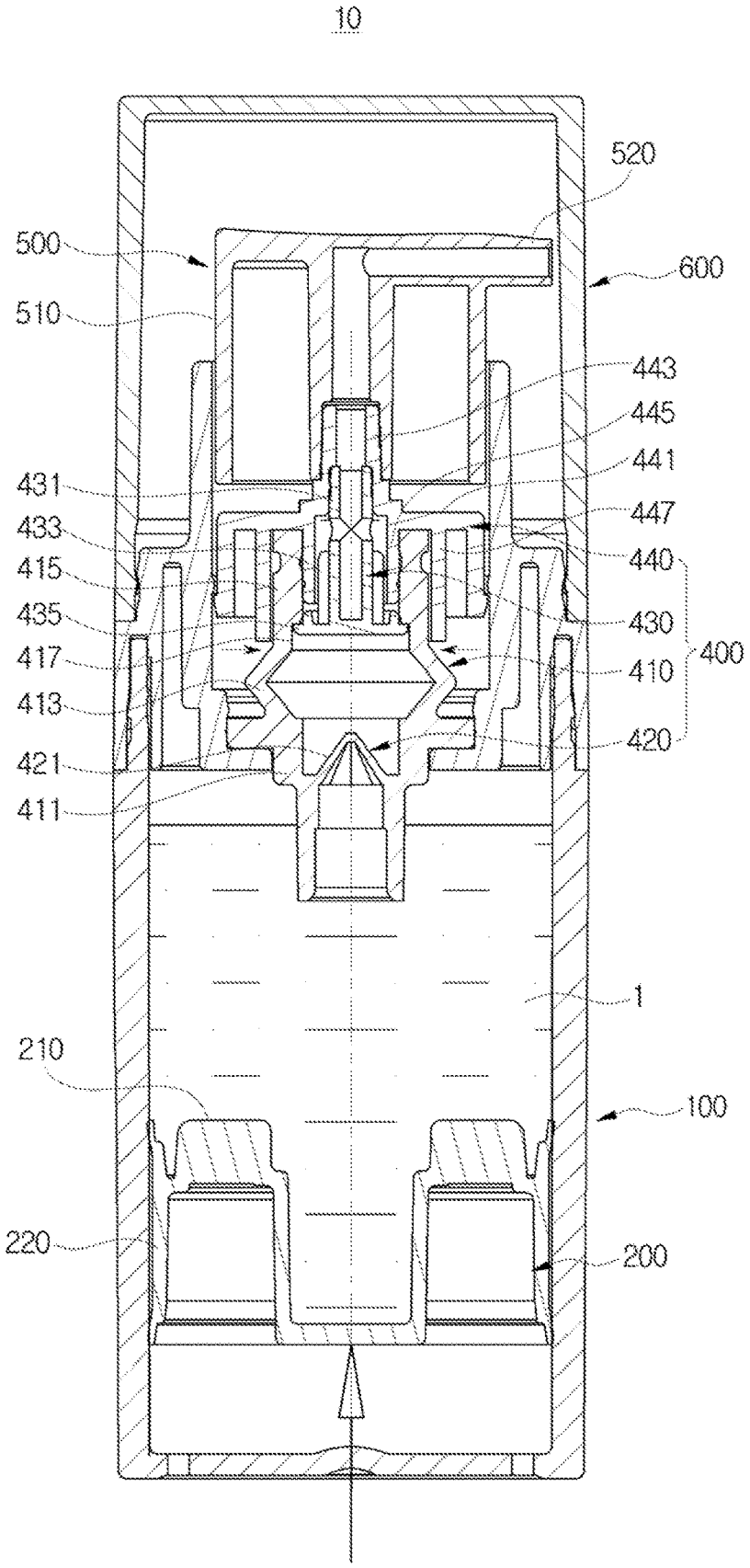
FIG. 17 is a view illustrating an operation state when a decompression vacuum test is performed on the case for the liquid state cosmetics according to an embodiment of the present invention.

FIG. 17 is a view illustrating an operation state when the decompression vacuum test is performed on the case for the liquid state cosmetics according to an embodiment of the present invention.

As illustrated in FIG. 17, since a decompression support 447 provided on the pumping cap 440 supports the outside of a nozzle insertion part 415 on which an undercut part 417 is disposed when a decompression vacuum test is performed on the case 10 for the liquid state cosmetics, the undercut part 417 may be prevented from being deformed by a pressure within the bellows part 413 to prevent the undercut part 417 from being opened, thereby preventing the content 1 from leaking through the undercut part 417.

When the decompression support 447 is not provided, the undercut part 417 may be deformed to be opened when the decompression occurs and thereby to cause the leakage of the content 1. Thus, according to the present invention, the decompression support 447 may be provided to previously prevent the content 1 from leaking when the decompression occurs.

Figure 18:
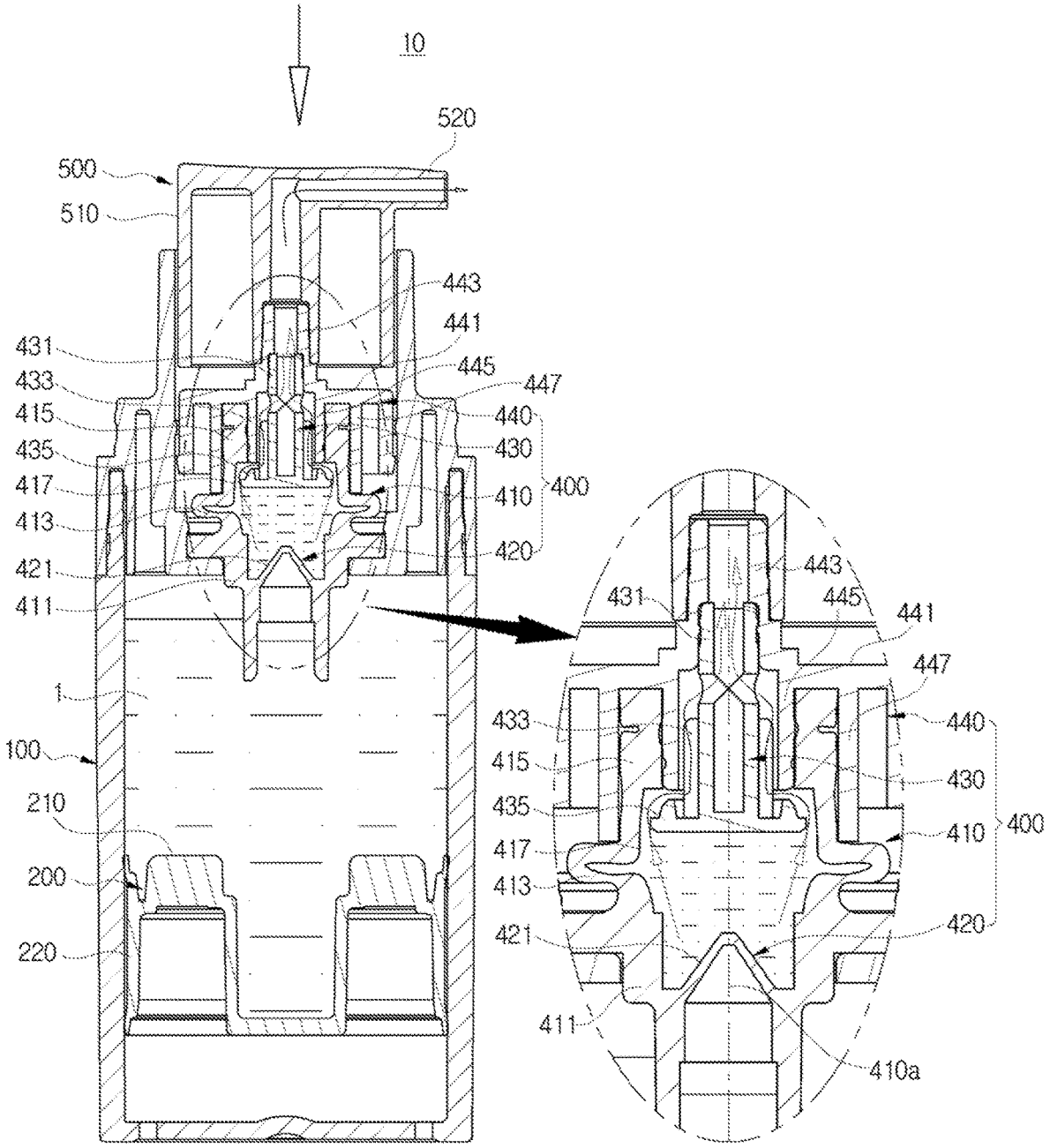
FIG. 18 is a view illustrating an operation state in which a content within the case for the liquid state cosmetics is discharged according to an embodiment of the present invention.

FIG. 18 is a view illustrating an operation state in which the content within the case for the liquid cosmetics is discharged according to an embodiment of the present invention.

As illustrated in FIG. 18, when the button unit 500 is pushed downward, the slit hole 421*a* is closed by the pressure within the pumping member 410 to seal the check valve 421. After the check valve 421 is sealed first, the bellows part 413 is compressed downward and thus elastically deformed in an external radius direction so that the close attachment with the flange part 435 is released to open the undercut part 417, and thus, the content 1 is discharged through the undercut part 417.

The content 1 discharged upward through the undercut part 417 is guided to the inflow hole 431*b* of the nozzle member 430 through an inflow guide piece 433 and is introduced into a nozzle hole 431*a*. Then, the content 1 is discharged to a discharge tube 443 of the pumping cap 440 through the nozzle hole 431*a* and then is discharged through a content outlet tube 520.

As described above, when the button unit 500 is pushed, the bellows part 413 of the pumping member 410 is elastically deformed to open the undercut part 417. Here, the upper side of the pumping member 410 is previously opened before the internal pressure is applied to the bellows part 413 to smoothly discharge the content by a fixed quantity in the state in which the internal pressure within the pumping member 410 is removed.

Figure 19:
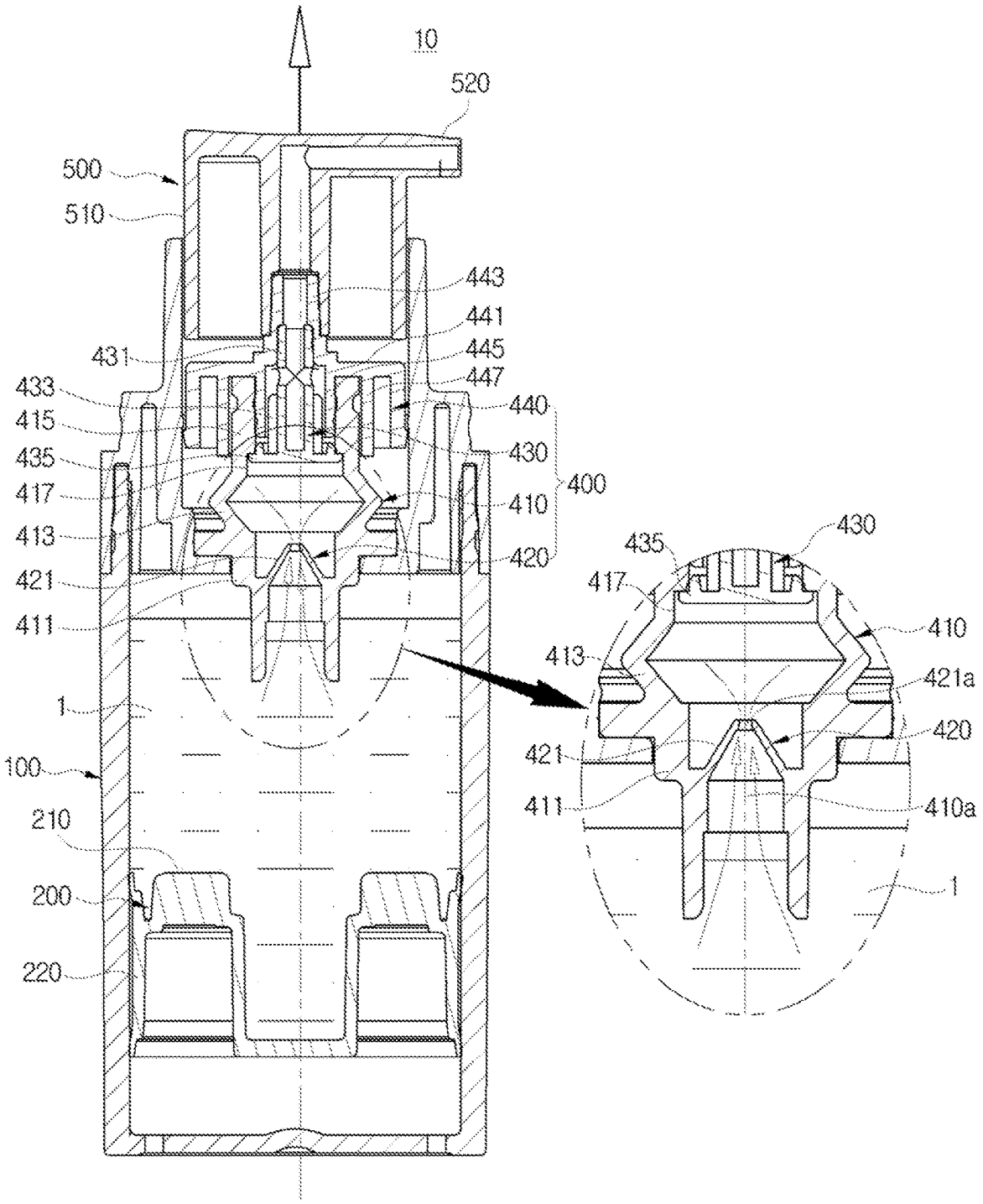
FIG. 19 is a view illustrating an operation state in which the discharge of the content within the case for the liquid state cosmetics is blocked according to an embodiment of the present invention.

FIG. 19 is a view illustrating an operation state in which the discharge of the content within the case for the liquid cosmetics is blocked according to an embodiment of the present invention.

As illustrated in FIG. 19, when the pushing of the button unit 500 is released, the button unit 500 returns upward by the elasticity of the pumping member 410. Here, the bellows part 413 is expanded upward and elastically deformed in the internal radius direction and thus is closely attached to the flange part 435 to seal the undercut part 417 and thereby to block the discharge of the content 1. Then, after the undercut part 417 is closed first, the slit hole 421*a* is opened by the pressure within the case body 100 to open the check valve 421, and thus, the content 1 is filled into the pumping member 410.

Thus, the pushing and pushing-releasing operation of the button unit 500 are repeatedly performed to discharge the content 1 and also always fill the content 1 into the pumping member 410 while being introduced into the pumping member 410.

Figure 20:
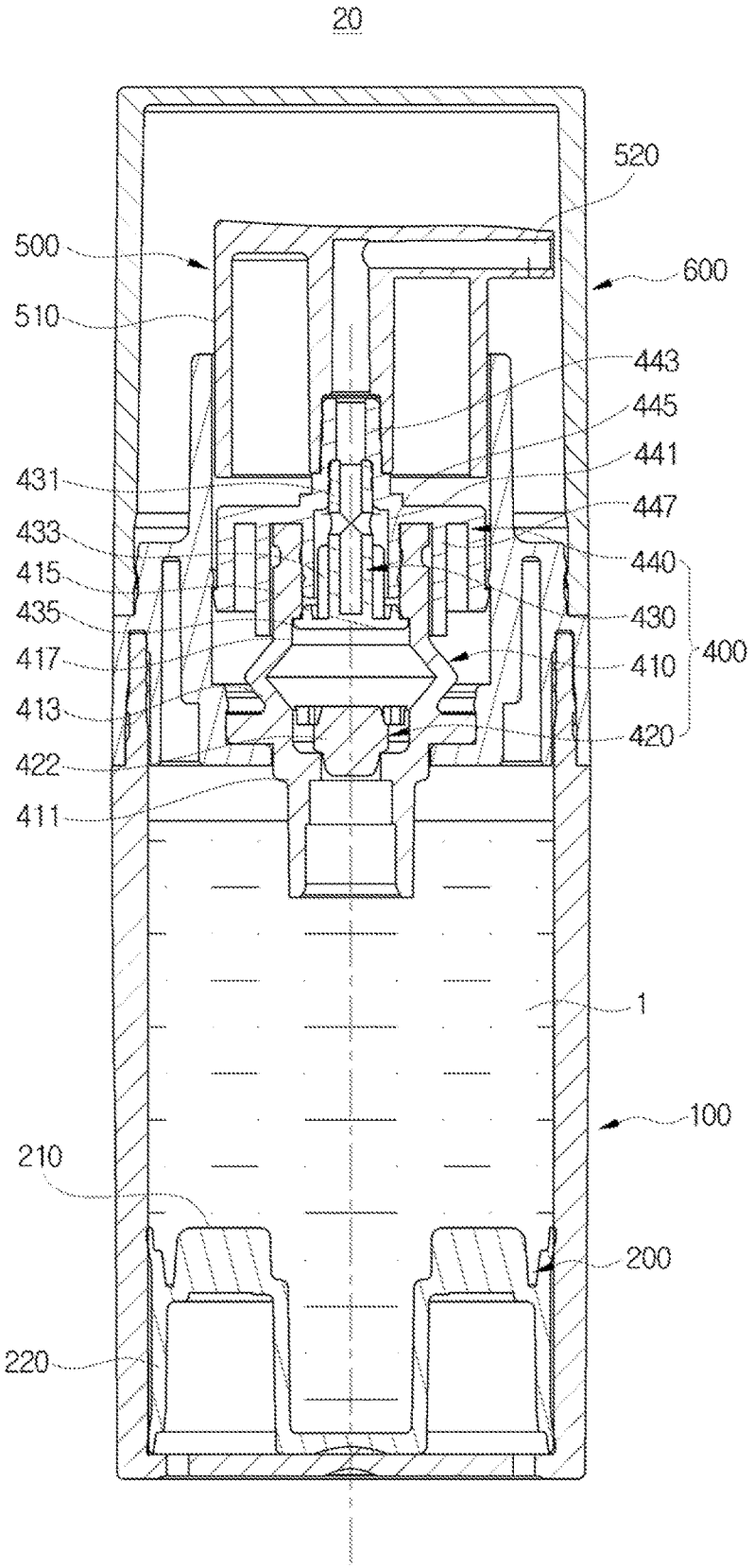
FIG. 20 is a longitudinal cross-sectional view of a case for liquid type cosmetics according to another embodiment of the present invention.
Figure 21:
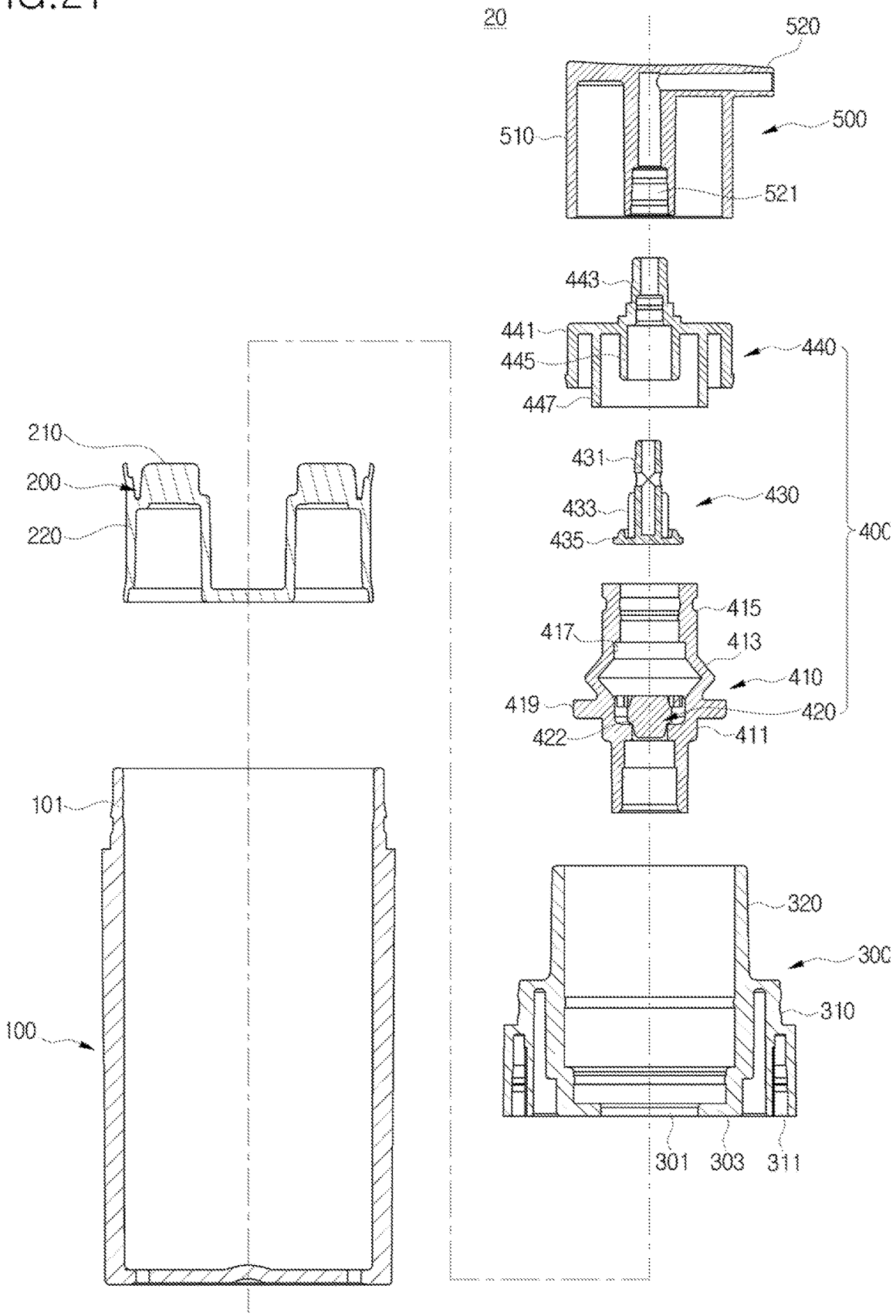
FIG. 21 is an exploded view of FIG. 20.

FIG. 20 is a longitudinal cross-sectional view of a case for liquid type cosmetics according to another embodiment of the present invention, and FIG. 21 is an exploded view of FIG. 20.

As illustrated in FIGS. 20 and 21, a case 20 for liquid state cosmetics according to another embodiment of the present invention may include a case body 100, a pressing holder unit 200, a shoulder unit 300, a pumping unit 400, a button unit 500, and a case lid unit 600.

This embodiment of the present invention is the same as the above-mentioned embodiment, which is described with reference to FIGS. 1 to 19, except for a pumping unit 400 having a disk valve 422.

Thus, detailed descriptions of the case body 100, the pressing holder unit 200, the shoulder unit 300, the button unit 500, and the case lid unit 600, which are components for performing the same function as those according to the above-mentioned embodiment, will be omitted, and thus, only the pumping unit 400 that is different from that according to the above-mentioned embodiment will be described in detail.

Figure 22:
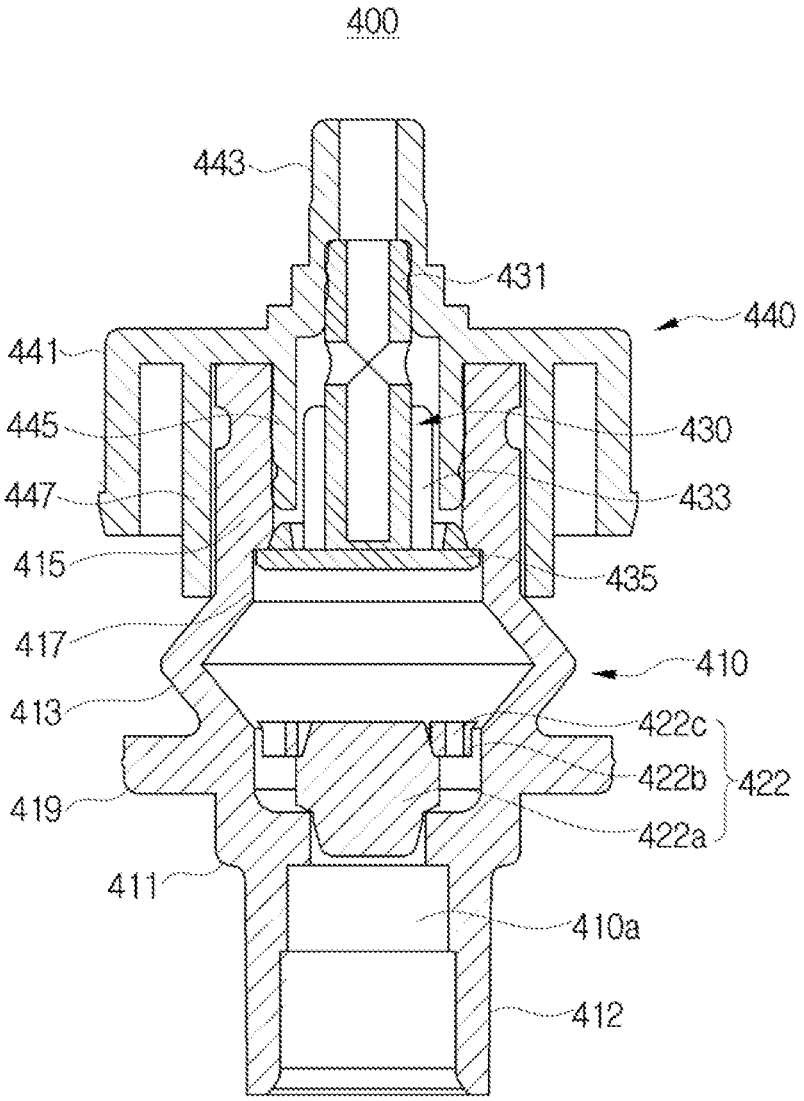
FIG. 22 is a longitudinal cross-sectional view illustrating a pumping unit of the case for the liquid state cosmetics according to another embodiment of the present invention.
Figure 23:
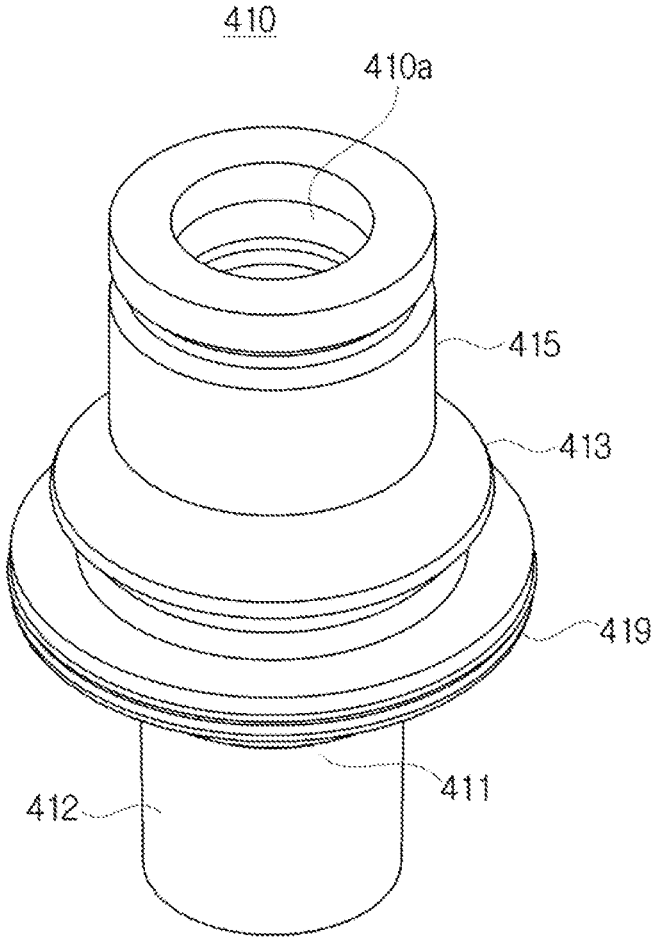
FIG. 23 is a perspective view illustrating a pumping member and a valve member of the pumping unit.
Figure 24:
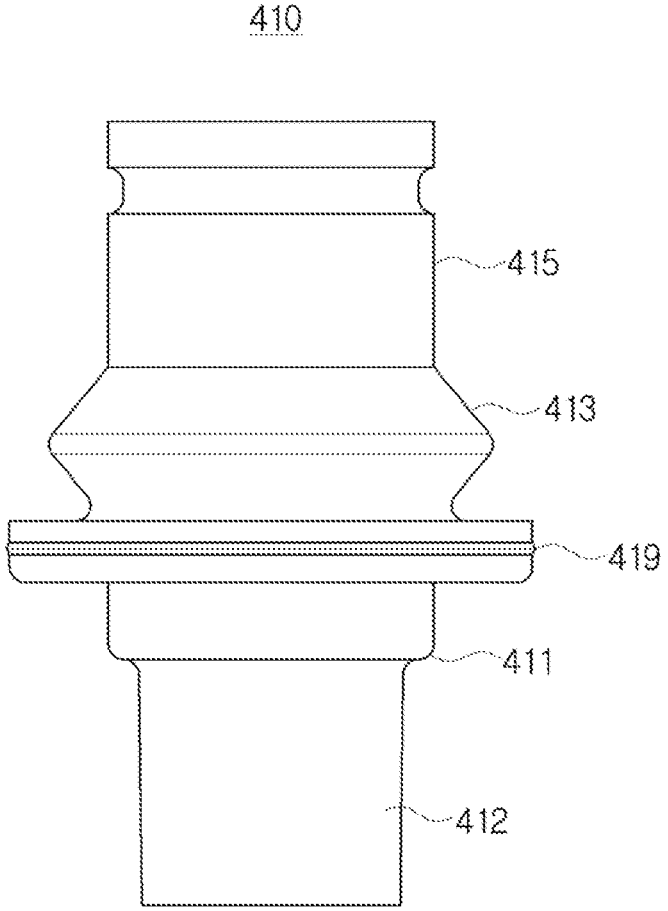
FIG. 24 is a front view of FIG. 23.
Figure 25:
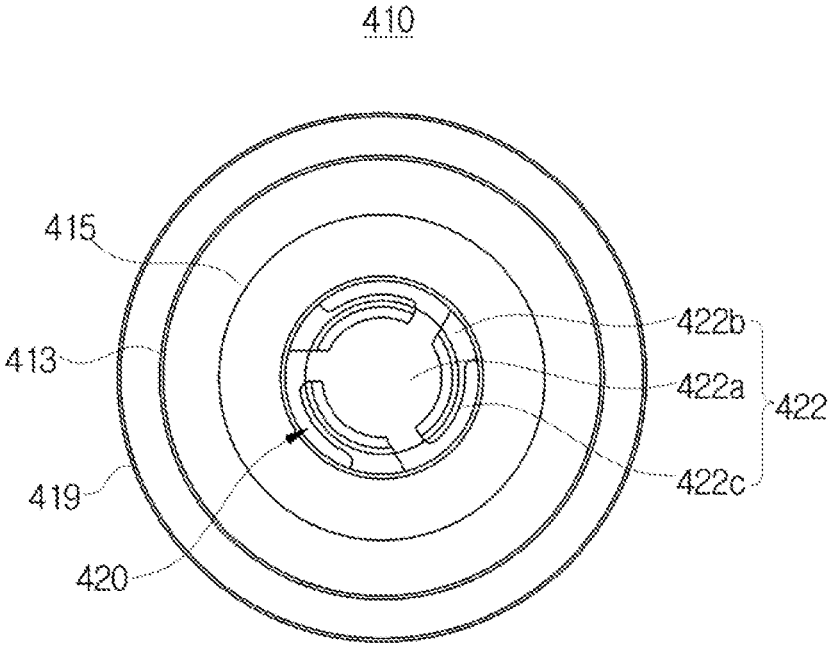
FIG. 25 is a plan view of FIG. 23.
Figure 26:
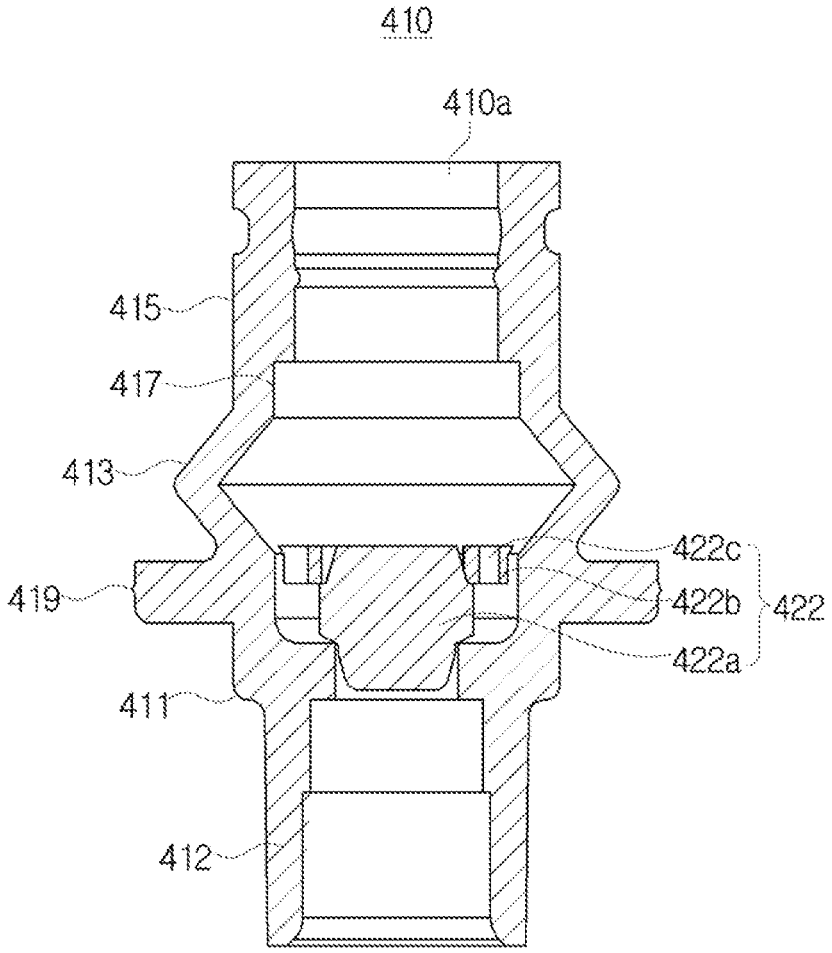
FIG. 26 is a longitudinal cross-sectional view of FIG. 23.

FIG. 22 is a longitudinal cross-sectional view illustrating the pumping unit of the case for the liquid state cosmetics according to another embodiment of the present invention, FIG. 23 is a perspective view illustrating a pumping member and a valve member of the pumping unit, FIG. 24 is a front view of FIG. 23, FIG. 25 is a plan view of FIG. 23, and FIG. 26 is a longitudinal cross-sectional view of FIG. 23.

As illustrated in FIGS. 22 to 26, the pumping unit 400 of the case 20 of the liquid state cosmetics according to another embodiment of the present invention may include the pumping member 410, a valve member 420, a nozzle member 430, and a pumping cap 440.

Here, the pumping member 410, the nozzle member 430, and the pumping cap 440 are the same as those according to the above-mentioned embodiment, and thus their detailed description will be omitted, and only the valve member 420 that is different from that according to the above-mentioned embodiment will be described in detail.

The valve member 420 is disposed below the pumping member 410 to open and close the content moving passage 410*a* communicating with the content discharge hole 303.

In this embodiment, the valve member 420 is provided as a disk valve 422, and the disk valve 422 is made of the same material as the pumping member 410.

In this embodiment, although the disk valve 422 is integrated with the pumping member 410, the present invention is not limited thereto. For example, the disk valve 422 may be provided as a separate part and then be coupled to the pumping member 410.

The disk valve 422 is provided in a disk plate 422*a* or a disk block shape inside a valve mounting part 411. A plurality of valve holes 422*c* are defined between elastic connection pieces 422*b* connecting the disk plate 422*a* to the valve mounting part 411, and the disk plate 422*a* ascend and descend by elastic deformation of the elastic connection pieces 422*b* to open and close a content moving passage 410*a* within the valve mounting part 411.

Figure 27:
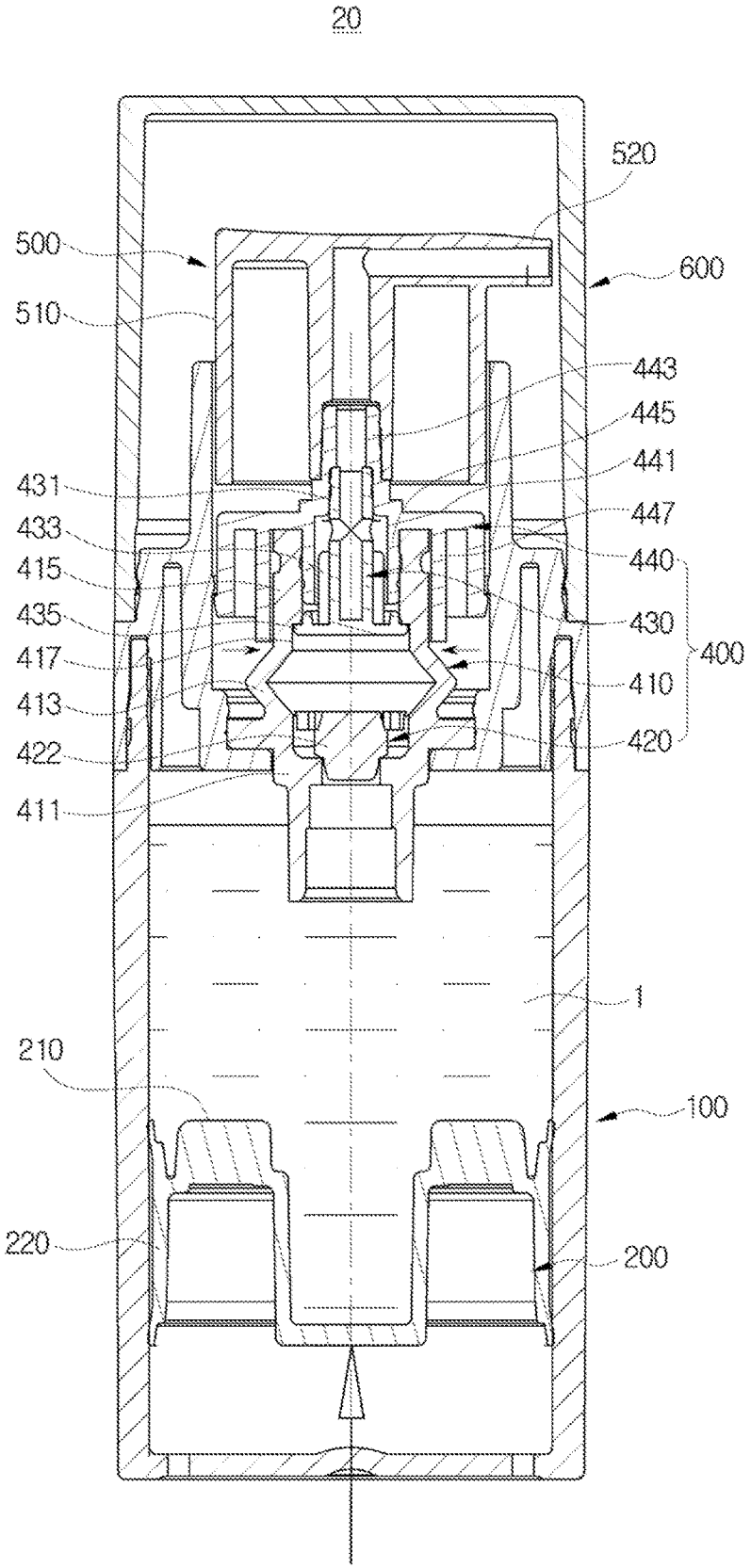
FIG. 27 is a view illustrating an operation state in which a decompression vacuum test is performed on the case for the liquid state cosmetics according to another embodiment of the present invention.

FIG. 27 is a view illustrating an operation state in which a decompression vacuum test is performed on the case for the liquid state cosmetics according to another embodiment of the present invention.

As illustrated in FIG. 27, since a decompression support 447 provided on the pumping cap 440 supports the outside of a nozzle insertion part 415 on which an undercut part 417 is disposed when a decompression vacuum test is performed on the case 20 for the liquid state cosmetics, the undercut part 417 may be prevented from being deformed by a pressure within the bellows part 413 to prevent the undercut part 417 from being opened, thereby preventing the content 1 from leaking through the undercut part 417.

When the decompression support 447 is not provided, the undercut part 417 may be deformed to be opened when the decompression occurs and thereby to cause the leakage of the content 1. Thus, according to the present invention, the decompression support 447 may be provided to previously prevent the content 1 from leaking when the decompression occurs.

Figure 28:
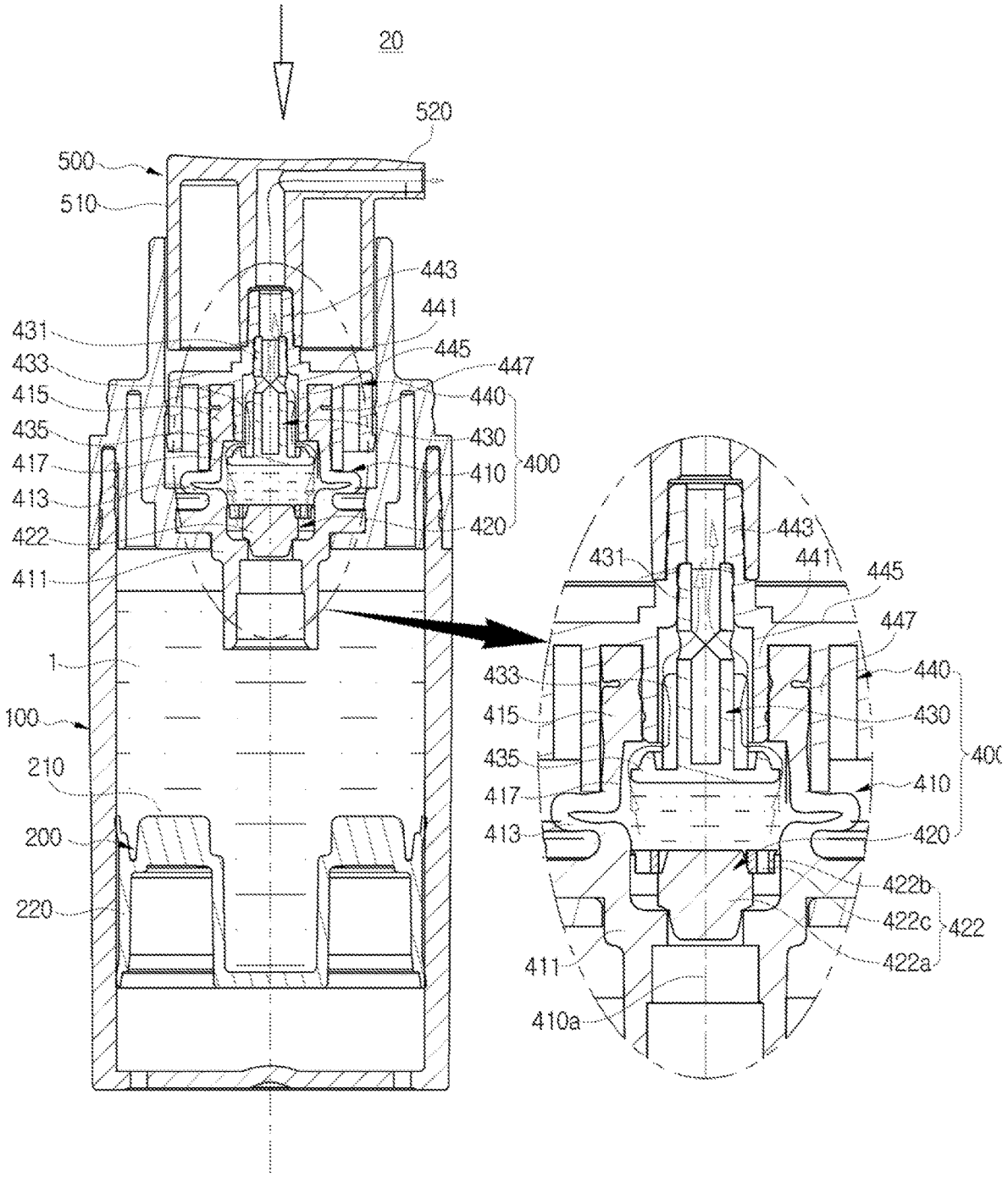
FIG. 28 is a view illustrating an operation state in which a content within the case for the liquid state cosmetics is discharged according to another embodiment of the present invention.

FIG. 28 is a view illustrating an operation state in which a content within the case for the liquid state cosmetics is discharged according to another embodiment of the present invention.

As illustrated in FIG. 28, when the button unit 500 is pushed downward, the disk plate 422*a* descends by the pressure within the pumping member 410 to seal a disk valve 422. After the disk valve 422 is sealed first, a bellows part 413 is compressed downward and thus elastically deformed in the external radius direction. Thus, the close attachment with the flange part 435 is released to open the undercut part 417 and thereby to discharge the content 1 within the pumping member 410 through the undercut part 417.

The content 1 discharged upward through the undercut part 417 is guided to the inflow hole 431*b* of the nozzle member 430 through an inflow guide piece 433 and is introduced into a nozzle hole 431*a*. Then, the content 1 is discharged to a discharge tube 443 of the pumping cap 440 through the nozzle hole 431*a* and then is discharged through a content outlet tube 520.

As described above, when the button unit 500 is pushed, the bellows part 413 of the pumping member 410 is elastically deformed to open the undercut part 417. Here, the upper side of the pumping member 410 is previously opened before the internal pressure is applied to the bellows part 413 to (1) smoothly discharge the content 1 by a fixed quantity in the state in which the internal pressure within the pumping member 410 is removed.

Figure 29:
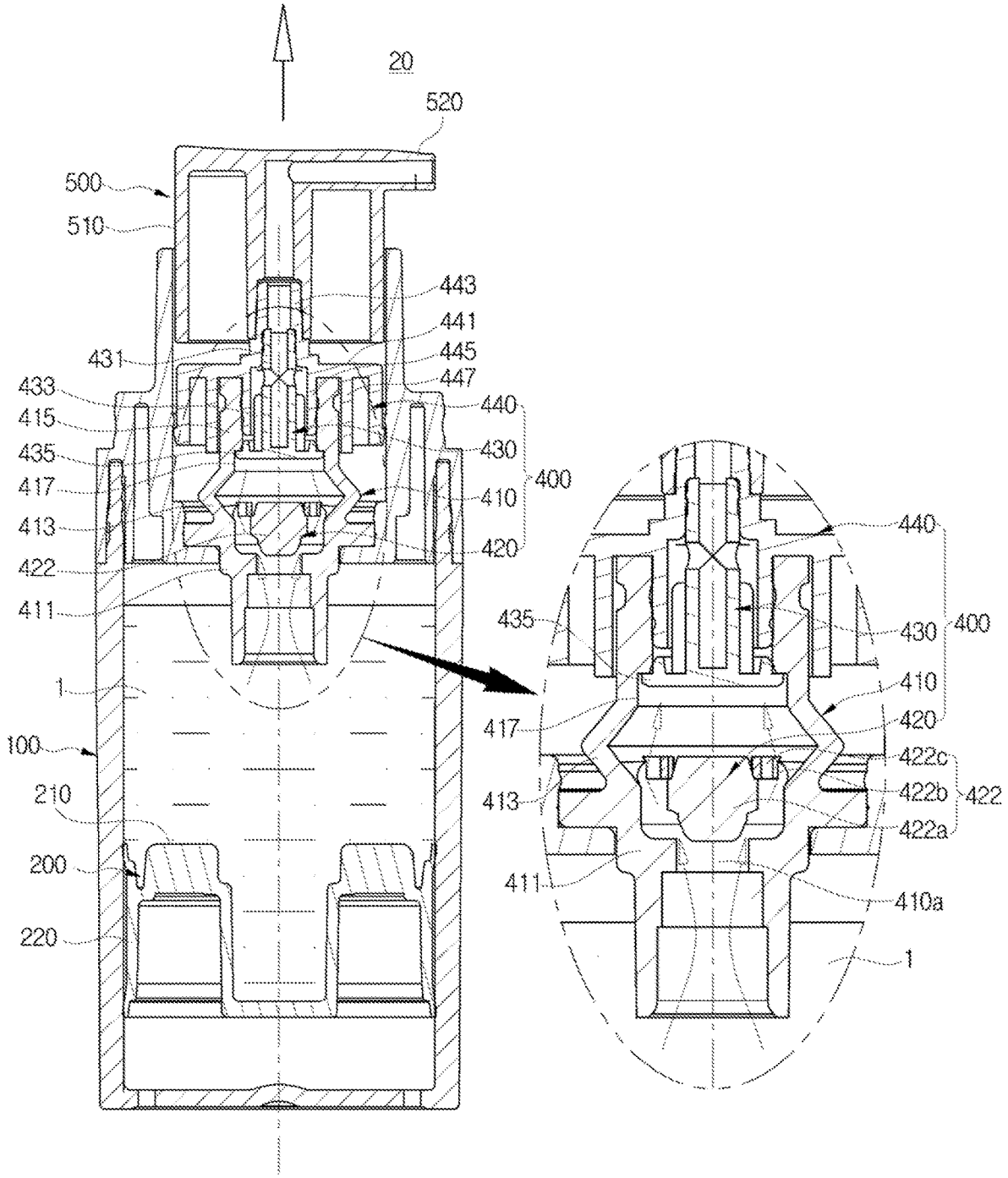
FIG. 29 is a view illustrating an operation state in which the discharge of the content within the case for the liquid state cosmetics is blocked according to another embodiment of the present invention.

FIG. 29 is a view illustrating an operation state in which the discharge of the content within the case for the liquid state cosmetics is blocked according to another embodiment of the present invention.

As illustrated in FIG. 29, when the pushing of the button unit 500 is released, the button unit 500 returns upward by the elasticity of the pumping member 410. Here, the bellows part 413 is expanded upward and elastically deformed in the internal radius direction and thus is closely attached to the flange part 435 to seal the undercut part 417 and thereby to block the discharge of the content 1. Then, after the undercut part 417 is closed first, the disk plate 422*a* ascends by the pressure within the case body 100 to open the disk valve 422, and thus, the content 1 is filled into the pumping member 410.

Thus, the pushing and pushing-releasing operation of the button unit 500 are repeatedly performed to discharge the content 1 and also always fill the content 1 into the pumping member 410 while being introduced into the pumping member 410.

Figure 30:
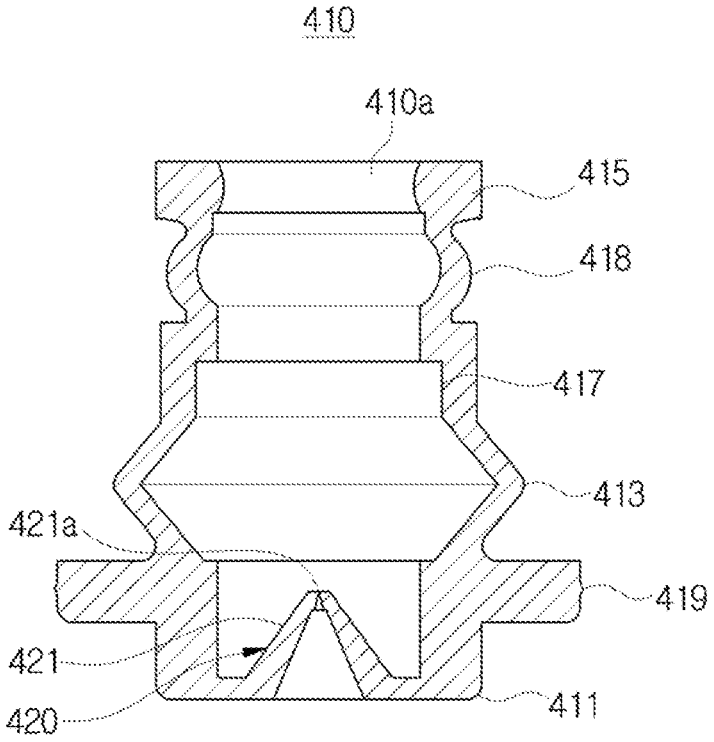
FIG. 30 is a cross-sectional view illustrating a pumping member of a pumping unit according to further another embodiment of the present invention.

FIG. 30 is a view of a pumping member of a pumping unit according to further another embodiment of the present invention.

As illustrated in FIG. 30, a pumping member 410 according to this embodiment may include a valve mounting part 411, a bellows part 413, a nozzle insertion part 415, an undercut part 417, and an elastic part 418.

Here, the valve mounting part 411, the bellows part 413, the nozzle insertion part 415, and the undercut part 417 except for the elastic part 418 are the same as those of the pumping member that is described in the above-mentioned embodiments.

Thus, the same reference numerals are used for the same components and a detailed description thereof is omitted, hereinafter, the elastic part 418 will be described in detail.

The elastic part 418 has a corrugated shape bent at least once at an intermediate portion in a longitudinal direction of the nozzle insertion part 415. When pushing and pushing-releasing operation of the button unit 500 are performed, the elastic part 418 is compressed and expanded in the longitudinal direction of the nozzle insertion part 415 to apply elastic force to the button unit.

In this embodiment, when external force is applied to the elastic part 418 to push the elastic part 418, the elastic part 418 has a thickness less than that of a cross-section of the nozzle insertion part 415 so that the elastic part 418 is elastically compressed.

As illustrated in FIG. 30, the elastic part 418 may have a single corrugated shape that is bent to protrude outward.

The shape of the elastic part 418 is not limited to the single corrugated shape. For example, the elastic part 418 may be bent in a multi-corrugated shape such as a bellows.

The corrugated shape and the thickness in cross-section of the elastic part 418 may variously vary, but is not limited thereto.

The elastic part 418 is elastically deformed by being pushed by the button unit 500 to apply elastic restoring force to the button unit 500.

Thus, when the button unit 500 is pushed by the external force, the elastic part 418 is compressed to allow the flange part to move downward with respect to the undercut part 417 and thereby to open the undercut part 417.

On the other hand, when the external force applied to the button unit 500 is removed, the elastic part 418 is expanded to its original state from the compressed state.

The button unit 500 is pushed upward by the elastic restoring force of the elastic part 418 to return to its original state.

Also, the flange part 435 that is spaced apart from the undercut part 417 ascends together with the button unit 500 and then is closely attached to the undercut part 417.

Thus, the gap between the undercut part 417 and the flange part 435 may be blocked to interrupt the discharge of the content.

Also, in this embodiment, the bellows part 413 has the corrugated circular shape to perform the pumping action due to the elasticity through the compression and the expansion.

When the button unit 500 is pushed downward, the bellows part 413 is elastically deformed to apply a pumping pressure to the content within the pumping member.

Figure 31:
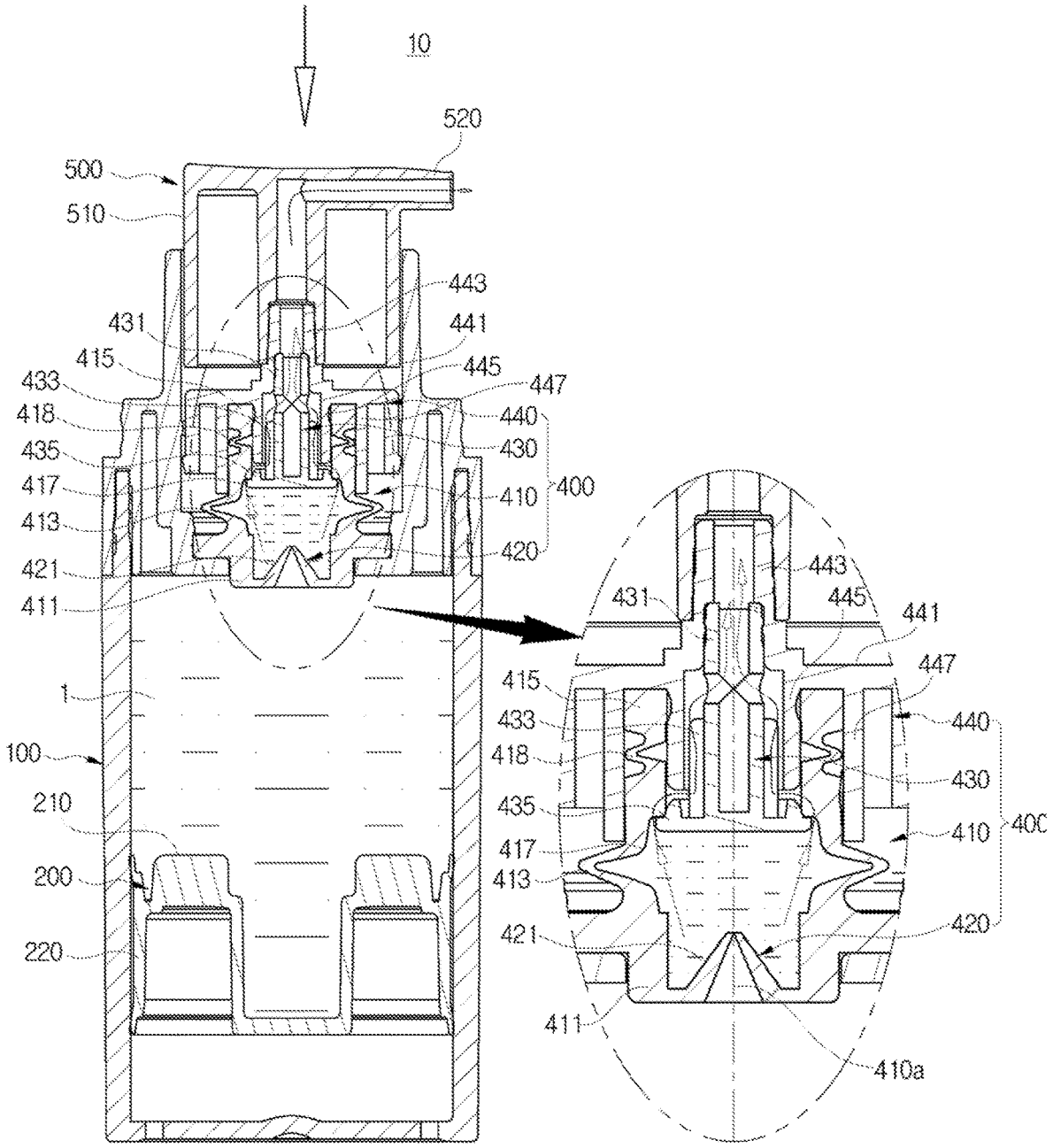
FIG. 31 is a view illustrating an operation state in which a content within a case for liquid state cosmetics, which is provided with a pumping member of FIG. 30, is discharged according to further another embodiment of the present invention.
Figure 32:
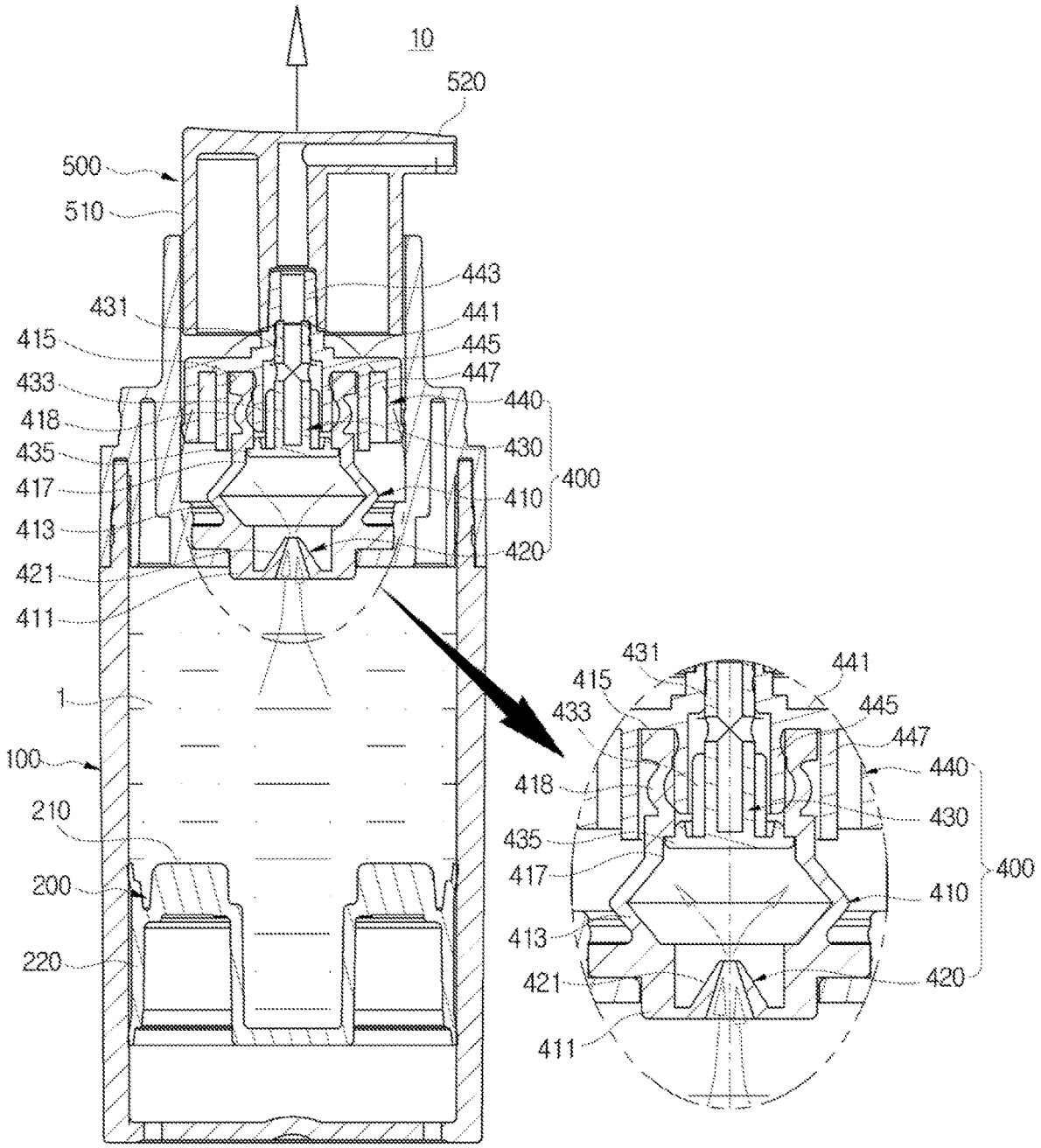
FIG. 32 is a view illustrating an operation state in which the discharge of the content within the case for the liquid state cosmetics is blocked according to further another embodiment of the present invention.

FIGS. 31 and 32 are views of a case for liquid state cosmetics, which includes a pumping member including an elastic part, according to further another embodiment of the present invention.

Hereinafter, a case for liquid state cosmetics according to further another embodiment of the present invention will be described with reference to FIGS. 31 and 32.

This embodiment is the same as the above-mentioned embodiment except for the pumping member 410.

Thus, detailed descriptions of the case body 100, the pressing holder unit 200, the shoulder unit 300, the button unit 500, and the case lid unit 600, which are components for performing the same function as those according to the above-mentioned embodiment, will be omitted, and thus, only the pumping unit 400 that is different from that according to the above-mentioned embodiment will be described in detail.

FIG. 31 is a view illustrating an operation state in which a content within the case for the liquid state cosmetics is discharged according to further another embodiment of the present invention.

As illustrated in FIG. 31, when a button unit 500 is pushed downward, a slit hole 431*a* is closed by a pressure within the pumping member 410 to seal a check valve 421. After the check valve 421 is sealed first, an elastic part 418 is compressed downward by a pumping cap 440, and thus, the nozzle member 430 descends.

Thus, the flange part 435 of the nozzle member 430 is spaced apart from an undercut part 417, and thus, the close attachment with the flange part 435 is released to open the undercut part 417.

Therefore, a content 1 within the pumping member 410 is discharged through the opened undercut part 417.

Here, a bellows part disposed below the undercut part 410 is pushed to be elastically deformed when the button unit 500 is pushed downward to compress the elastic part 417 downward.

The bellows part 413 is elastically deformed to apply pressing force to the inside of the pumping member 410.

Thus, the content 1 within the pumping member 410 is discharged upward along a discharge path through the opened undercut part 419 by the pumping pressure of the bellows part 413.

As described above, when the button unit 500 is pushed, the elastic part 418 of the pumping member 410 is compressed before the internal pressure is applied to the pumping member 410 to open the undercut part 417. Thus, the content 1 may be smoothly discharged by a fixed quantity in the state in which the apply of the internal pressure is released from the pumping member 410.

FIG. 32 is a view illustrating an operation state in which the discharge of the content within the case for the liquid state cosmetics is blocked according to further another embodiment of the present invention.

As illustrated in FIG. 32, when the pushing of the button part 500 is released, the pushed elastic part 418 is expanded upward by the elasticity of the elastic part 418, and thus, the button unit 500 returns upward.

Thus, the nozzle member 430 connected to the button unit 500 ascends to allow the flange part 435 to seal the undercut part 417 and thereby to close a gap between the undercut part 417 and the flange part 435.

Thus, the undercut part 417 is sealed to block the discharge of the content 1.

After the undercut part 417 is closed first, the bellows part 413 that is elastically deformed returns to its original state and thereby to generate a negative pressure therein.

Thus, the slit hole 421*a* is opened to open the check valve 421, and thus, the content 1 contained in the case body 100 is introduced and filled into the pumping member 410 through the slit hole 421*a*.

Thus, the pushing and pushing-releasing operation of the button unit 500 are repeatedly performed to discharge the content 1 and also always fill the content 1 into the pumping member 410 while being introduced into the pumping member 410.

In the case for the liquid state cosmetics according to the present invention, the content pumping member may be made of the elastic material, e.g., the synthetic resin material having the elasticity, and thus, the existing spring component may be omitted.

Thus, the number of parts of the case for the cosmetics may be reduced to simplify the structure of the case, thereby reducing the manufacturing costs.

In addition, since the pumping action is performed using the elastic synthetic resin instead of the existing spring made of the metal material, the spring made of the metal material may not be used to prevent the content from being deteriorated due to corrosion of the spring.

In addition, according to the present invention, when the decompression vacuum test is performed on the case for the liquid state cosmetics, the flange part of the nozzle member may be closely attached to and supported by the undercut part of the pumping member to prevent the undercut part from being opened by the internal pressure of the case, thereby preventing the content from leaking through the undercut part.

For example, if the undercut part is not provided, like the related art, when the decompression vacuum test is performed, the content may leak between the nozzle member and the pumping member at the pressure of about 200 bars. However, like the present invention, in the case in which the he flange part of the nozzle member and the undercut part of the pumping member are provided in the pumping unit, the flange part may be closely attached to and supported by the undercut part. Thus, when the decompression vacuum teat is performed, the leakage of the content may be prevented in a range of about 800 bars to about 1,000 bars to improve reliability of a product.

In addition, according to the present invention, when the decompression vacuum test is performed on the case for the liquid state cosmetics, the outside of the nozzle insertion part on which the undercut part is disposed may be supported by the decompression support to prevent the undercut from being deformed by the pressure within the bellows part and thereby to prevent the undercut part from being opened, thereby preventing the content from leaking through the undercut part.

If the decompression support is not provided, when the decompression occurs, the undercut part may be deformed and opened to cause the automatic leakage of the content. Thus, according to the present invention, the decompression support may be provided to previously prevent the content from leaking when the decompression occurs.

In addition, when the button unit is pushed, the bellows part and the elastic part of the pumping member may be elastically deformed to open the undercut part. Thus, in the state in which the upper side of the pumping member is opened to remove the internal pressure within the pumping member before the internal pressure is applied to the bellows part, the content may be smoothly discharged by a fixing quantity.

Also, according to the present invention, the valve member constituted by the check valve or the disk valve may be integrated with the pumping member.

Thus, if the valve member is provided as a separate part with respect to the pumping member, the content may leak through the coupled portion between the valve member and the pumping member, and also, the assembly may be complicated. However, according to the present invention, when the valve member is integrated with the pumping member, the occurrence of the leakage of the content through the coupled portion between the valve member and the pumping member may be prevented, and the number of parts may be reduced to simplify the structure of the case, thereby reducing the manufacturing costs.

Although the embodiment of the present invention is described with reference to the accompanying drawings, those with ordinary skill in the technical field of the present invention pertains will be understood that the present invention can be carried out in other specific forms without changing the technical idea or essential features.

Thus, the above-disclosed embodiments are to be considered illustrative and not restrictive.

Accordingly, the scope of the present invention is defined by the appended claims rather than the foregoing description and the exemplary embodiments described therein. Various modifications made within the meaning of an equivalent of the claims of the invention and within the claims are to be regarded to be in the scope of the present invention.

What is claimed is:

1. A case for liquid state cosmetics, the case comprising:

(A) a case body in which a liquid content is contained;

(B) a shoulder unit coupled to an upper portion of the case body and having a content discharge hole at a central portion thereof;

(C) a pumping unit inserted into the shoulder unit and connected to the content discharge hole to discharge the content through pumping action due to elasticity, wherein the pumping unit comprises:

(I) a pumping member which is made of an elastic material so that the content is discharged through the pumping action such as compression and expansion due to the elasticity and through which a content moving passage connected to the content discharge hole passes through the inside thereof, wherein the pumping member comprises:

(a) a valve mounting part inserted into and coupled to a content discharge hole of the shoulder unit and provided with the valve member therein;

(b) a bellows part extending upward from the valve mounting part in a bellows shape and compressed and expanded to perform pumping action due to elasticity;

(c) a nozzle insertion part which extends upward from the bellows part and is coupled to a lower portion of the pumping cap and in which the nozzle member is inserted therein; and (d) an undercut part stepped so that a lower inner diameter thereof is more expanded than an upper inner diameter thereof on an inner circumferential surface of the nozzle insertion part;

(i) wherein, in the state in which the nozzle member is inserted into the nozzle insertion part, a flange part protruding outward from a lower end of the nozzle member is closely attached to and supported by the undercut part; and (ii) when the button unit is pushed downward, the bellows part is vertically compressed and elastically deformed in an external radius direction to release the close attachment with the flange part and open the undercut part so that the content is discharged, and when the button unit returns upward, the bellows part is vertically expanded and elastically deformed in an internal radius direction so as to be closely attached to the flange part and seal the undercut part and thereby to block the discharge of the content;

(II) a valve member provided in a lower portion of the pumping member to open a lower side of the content moving passage communicating with the content discharge hole;

(III) a nozzle member inserted into an upper portion of the pumping member to open and close an upper side of the content moving passage while coming into contact and non-contact with the pumping member when the pumping member is elastically deformed, thereby discharging the content; and (IV) a pumping cap which is coupled to an upper portion of the pumping member and in which a discharge tube connected to the nozzle member is disposed on an upper portion thereof; and (D) a button unit coupled to an upper portion of the shoulder unit and connected to the pumping unit to operate the pumping unit so that the content is discharged by pumping action of the pumping unit, the button unit having a button body extending into the upper portion of the shoulder unit, an entirety of the button unit moveable with respect to the shoulder unit.

2. The case of claim 1, wherein the undercut part is provided as a stepped groove having an inner diameter corresponding to an outer diameter of the flange part on an inner circumferential surface of a connection portion between an upper end of the bellows part and a lower end of the nozzle insertion part.

3. The case of claim 1, wherein the nozzle member comprises:

a nozzle body inserted into a nozzle fixing tube protruding from a lower portion of the pumping cap and connected to the discharge tube and having a nozzle hole therein and an inflow hole connected to the nozzle hole to introduce the content into the nozzle hole in a side portion thereof;

an inflow guide piece radially protruding from an outer circumferential surface of the nozzle body to provide a content inflow path between the nozzle fixing tube and the nozzle body and thereby to guide the content into the inflow hole; and a flange part protruding in an annular shape from a lower end of the nozzle body, having an outer diameter corresponding to an inner diameter of the undercut part, and inserted into the nozzle insertion part so as to be closely attached to and supported by the undercut part.

4. The case of claim 3, wherein the pumping cap further comprises:

a cap body inserted into a shoulder tube protruding from an upper portion of the shoulder unit;

a discharge tube protruding from a center of an upper portion of the cap body and connected to a content outlet tube disposed in the button unit; and a nozzle fixing tube protruding from a center of a lower portion of the cap body to communicate with the discharge tube, inserted into and coupled to the upper end of the pumping member, having a nozzle fixing groove, into which the upper end of the nozzle body is fitted into and fixed to in the state in which the nozzle body is inserted, in an upper portion thereof.

5. The case of claim 4, wherein the pumping cap further comprises a decompression support extending to protrude downward from a lower portion of the cap body at a predetermined distance with respect to an outer circumferential surface of the nozzle fixing tube and supporting an outer circumferential surface of the nozzle insertion part inserted into and coupled to the outside of the nozzle fixing tube, wherein the decompression support supports the outside of the nozzle insertion part on which the undercut part is disposed when a decompression vacuum test is performed on the case for the liquid state cosmetics to prevent the undercut part from being opened by a pressure within the bellows part and thereby to prevent the content from leaking through the undercut part.

6. The case of claim 5, wherein the decompression support extends up to a connection portion between an upper end of the bellows part and a lower end of the nozzle insertion part.

7. The case of claim 1, wherein the valve member is integrated with the pumping member.

8. The case of claim 1, wherein the valve member comprises a check valve which extends to the inside of the valve mounting part to form an upward cone shape and in which a slit hole is defined in an upper end thereof so that the slit hole is spread or closed by a pressure to open and close the content moving passage, wherein, when the button unit is pushed downward, the slit hole is closed by the pressure within the pumping member to seal the check valve, and after the check valve is sealed first, the bellows part is vertically compressed and elastically deformed in an outer radius direction to release the close attachment with the flange part and open the undercut part and thereby to discharge the content within the pumping member through the undercut part, and when the button unit returns upward, the bellows part is vertically expanded and elastically deformed in an internal radius direction so as to be closely attached to the flange part and seal the undercut part and thereby to block the discharge of the content, and after the undercut part is closed first, the slit hole is opened by the pressure within the case body to open the check valve and thereby to fill the content into the pumping member.

9. The case of claim 1, wherein the valve member comprises a disk valve in which a disk plate is disposed inside the valve mounting part, a plurality of valve holes are defined between elastic connection pieces connecting the disk plate to the valve mounting part, and the disk plate ascends and descends by elastic deformation of the elastic connection pieces to open and close the content moving passage within the valve mounting part, wherein, when the button unit is pushed downward, the disk plate descends by the pressure within the pumping member to seal the disk valve, and after the disk valve is sealed first, the bellows part is vertically compressed and elastically deformed in an outer radius direction to release the close attachment with the flange part and open the undercut part and thereby to discharge the content within the pumping member through the undercut part, and when the button unit returns upward, the bellows part is vertically expanded and elastically deformed in an internal radius direction so as to be closely attached to the flange part and seal the undercut part and thereby to block the discharge of the content, and after the undercut part is closed first, the disk plate ascends by the pressure within the case body to open the disk valve and thereby to fill the content into the pumping member.

10. The case of claim 1, wherein the pumping member further comprises an elastic part having a corrugated shape bent at least once at an intermediate portion in a longitudinal direction of the nozzle insertion part and compressed and expanded in the longitudinal direction of the nozzle insertion part when the pushing and pushing-releasing operation are performed to apply elastic force to the button unit.

11. The case of claim 10, wherein the pumping member further comprises an undercut part stepped so that a lower inner diameter thereof is more expanded than an upper inner diameter thereof on an inner circumferential surface of the nozzle insertion part, wherein, in the state in which the nozzle member is inserted into the nozzle insertion part, the flange part protruding outward from a lower end of the nozzle member is closely attached to the undercut part, and when the button unit is pushed downward, the elastic part is compressed downward by the pumping cap to allow the nozzle member to descend so that the close attachment of the undercut part to the flange part is released to open the undercut part and thereby to discharge the content, and when the button unit returns upward, the elastic part is expanded upward to allow the nozzle member to ascend so that the undercut part is closely attached to the flange part to block the discharge of the content.

* * * * *